US006243878B1

(12) United States Patent
Khemka et al.

(10) Patent No.: US 6,243,878 B1
(45) Date of Patent: Jun. 12, 2001

(54) ARTICLE OF CLOTHING

(76) Inventors: Sheel Khemka; Nana-Akoto Osei, both of c/o Starcke Limited 4 Old Court House, Old Court Place, High Street Kensington, London W8 4PD (GB)

( * ) Notice: Subject to any disclaimer, the term of this patent is extended or adjusted under 35 U.S.C. 154(b) by 0 days.

(21) Appl. No.: 09/051,883

(22) PCT Filed: Aug. 22, 1997

(86) PCT No.: PCT/GB97/02281

§ 371 Date: Nov. 16, 1998

§ 102(e) Date: Nov. 16, 1998

(87) PCT Pub. No.: WO98/07339

PCT Pub. Date: Feb. 26, 1998

(30) Foreign Application Priority Data

Aug. 23, 1996 (GB) ..... 9617736

(51) Int. Cl.[7] ..... A41D 13/00
(52) U.S. Cl. ..... 2/227; 2/238; 2/234
(58) Field of Search ..... 2/227, 228, 238, 2/69, 70, 80, 79, 83, 400–408, 234

(56) References Cited

U.S. PATENT DOCUMENTS 3,425,063 2/1969 Brown .
3,823,419 7/1974 Breitbart .
4,578,828 4/1986 Smith et al. .
5,010,595 4/1991 Stradley .
5,539,926 * 7/1996 Mantos ..... 2/228 X
5,983,401 * 11/1999 Ohara ..... 2/227

FOREIGN PATENT DOCUMENTS

2336681 * 1/1975 (DE) ..... 2/227
1 090 076 3/1955 (FR) .
333 002 8/1930 (GB) .
21127276 * 4/1984 (GB) ..... 2/227

* cited by examiner

*Primary Examiner*—Gloria M. Hale
(74) *Attorney, Agent, or Firm*—Lowe Hauptman Gilman & Berner, LLP

(57) ABSTRACT

An article of clothing has a crotch portion separating two leg portions (10, 14; 12, 16) of openings, and having in the crotch portion a crotch fly (26) extending along the perineal region, the crotch fly being openable and closable by fastening means (34) which in the closed position are concealed, and, preferably, being provided along a line in the crotch portion in a manner so as to give the appearance of a normal stitched seam in the closed position.

19 Claims, 16 Drawing Sheets

ARTICLE OF CLOTHING

This invention relates to an article of clothing. In particular it is concerned with an article of clothing adapted to provide access to a part of body normally covered.

In mild and warm climates where ambient temperatures is relatively high an article of clothing generally serves to prevent exposure to view of particular parts of the body rather than for providing for weather protection or heat retention. In such circumstances access by a wearer to parts of the body for washing or other hygienic purposes is not usually a significant problem.

In colder climates quite apart from limiting exposure to view an article of clothing needs to provide a degree of weather protection of heat retention. However given substantial coverage of the body by an article or articles of clothing it becomes a matter of practical convenience to provide means for accessing a particular part of the body for hygienic or toiletry purposes. While a garment can be removed for such purposes it is more convenient for a part of the garment to be provided means to enable an aperture to be provided for access to a local body region.

In particular for purposes of dispensing urine from a male body a garment in the form of trousers or shorts are conventionally provided with a frontal slot, commonly referred to as a "fly", closed by a zip, buttons or a closure means such as VELCRO hook-and-loop fasteners. This enables access to be readily made to the single male organ involved.

U.S. Pat. No. 4,578,828 (Smith) disclosed women's trousers for use in the field or by women in the military to permit then to urinate or defecate or perform both at the same time without having to undress. For this purpose the trousers are provided with both a front opening and a crotch opening that extends from the base of the front fly to the back of the rear waistband. The crotch opening may be closed by a regular zip or an "invisible" zip fastener, or buttons or VELCRO hook-and-loop fasteners, sewn along the crotch seam line of the trousers, and it is suggested that when fully closed the pulley of the crotch zip fastener should be concealed from view beneath the placket of the front fly. An internal 'padded fly' is provided to protect the crotch area of the wearer from the zip.

WO-93/13679 (Gregorio) discloses women's trousers having a crotch opening extending from the lower end of the front of the trouser to a region at the rear that is not as far as the rear waistband, the opening being closable by a zip or buttons etc.

Australian-Patent U-040086/93 (Pietralunga) discloses women's trousers having a crotch opening taking the form of a closed loop extending from just below the front fly to a region at the rear that is not as far as the rear waistband, the opening being closable by a zip or buttons or other forms of fastener.

An article of jeans, classics trousers, shorts, and casual bottoms with an unexposed crotch fly is generally more acceptable to the wearer (and to the observer) than one with fastening means in the crotch that is exposed.

Given that jeans, trousers etc. with crotch flies are not as yet generally worn it may be preferable to the wearer that the crotch fly not only be unexposed but also concealed sufficiently well, when the article is worn, so as to present to an observer the outward appearance or illusion that there is in fact no crotch fly present, or at least so that he/she cannot tell the difference between an article of jeans, classics trousers etc. of conventional jeans or classics trousers structure and design and an article of jeans, classics trousers, etc. with an added crotch fly.

The present invention relates to articles of jeans, classics trousers, shorts, casual bottoms etc. with added crotch openings that are concealed in such a way that when the article is worn an observer cannot (easily) mark out the difference between jeans, classics trousers, shorts, casual bottoms etc. with the added crotch opening and those of conventional jeans and classics trousers etc. structure and design; the fastening means of the crotch opening of the present invention being readily accessible by the wearer for opening and closing.

Smith & Smith (U.S. Pat. No. 4,578,828) discuss a long crotch fly (i.e. from the lower end of the front of the article and extending through the crotch as far as the rear waist) that can only be concealed by way of a 'concealed/invisible' zip (this is a reversed zip with a pulley back to front, standardly used in women's skirts and trousers and is invisible from the outside except for the pulley of the zip which lies exposed). They mention that the pulley can be hidden under the placket of the front fly. This raises two problems:

(a) What happens to the pulley when there is no front fly and therefore no placket (i.e. ladies' classics trousers with a side zip are common)?—It clearly lies exposed.

(b) To conceal the pulley under the placket, at least one side of the zip must deviate at its upper end so that the pulley can rest under the placket. Such 'deviation' of an end of the zip is quite novel in clothing and is not disclosed in any of the prior art. If there is no deviation of the zip teeth of the concealed/invisible zip then the pulley of the zip lies exposed on the surface of the garment.

Where there is no front fly and placket then the 'concealed/invisible' zip deviates at one end (either the front or back) under a lip of material and is thereby properly concealed under the lip when the trouser is worn (such a 'lip' is not visible to an observer and gives the outward appearance or illusion of a closed seam as in the front and rear seams of the article).

It is preferable that the zip pulley is unexposed when the crotch fly is closed so as to avoid problems of an exposed zip pulley being caught by everyday objects which may in turn lead to otherwise avoidable wear and tear in that region of the article, as well as for the reasons of concealment presented earlier.

The present invention discloses women's jeans, classics trousers etc. with a long crotch fly (i.e. extending from the lower end of the front of the trouser/jean/sportswear item through the crotch and as far as the rear waist) where the fastening means is fully concealed when the article is worn and the fastening means is closed—both with regular zips/buttons that are concealed under flaps/facings of material, and concealed/invisible zips where the pulley of the zip is also properly concealed.

Stradley (U.S. Pat. No. 510,595) and Pasquier (FR-1090076) are the only persons known other than Smith & Smith (U.S. Pat. No. 4,578,828) who disclose concealment means of a zip or button fastener of an opening in trousers that extends through the crotch.

Stradley (U.S. Pat. No. 5,010,595) discusses concealment of a crotch opening in so far as there is a crotch fly extending all-the-way-around (from the front waist and through the crotch as far as the rear waist) whose fastening means may be covered by opposing folded edges of the sides of the garment that are provided with interior lining and that meet (to cover a regular zip). Stadley does not disclose whether or not the sides of her garment each have a line of top-stitching close to and parallel to the line of the folded edges—if not, then her folded edges will tend not to lie flat onto the sides of the garment when the article is worn; parallel top-stitching reinforces the 'concealment flaps' (i.e., the folded edges) with an inner boundary that sets them in place, thereby significantly improving their 'staying flat' properties when the article is worn. If Stradley intended her covering means to be top-stitched along the full length of the crotch fly, then her garment is less effective from the point of view of concealment of the presence of a crotch fly (conventional top-stitching being visible to an observer) than one with covering means that is not top-stitched yet that rests flat onto the sides of the garment through other reinforcement means that is concealed from the exterior view (e.g. novel means disclosed in the present invention).

Pasquier (FR-1090076) discusses concealment in so far as there is a crotch fly extending all-the-way-around with a fastening means that may be covered by:

(i) a closure means (over the whole extent of the crotch fly) that is otherwise similar in its construction and design to a conventional placket of a front fly (the diagrams illustrate a placket that is top-stiched as in conventional plackets);

(ii) extended sides of the garment, on both sides, that meet to cover the fastening means when closed (the diagrams illustrate extended sides of the garment that are top-stiched close to and parallel to their meeting edges, thereby assisting the edges to lie flat when the fly is closed and the garment is worn).

Smith & Smith, Stradley, and Pasquier all attempt to devise trousers, shorts etc. that have an opening that extends through the crotch and which are thereby useful for the excretion of bodily fluids without the need to partially disrobe, and yet that maintain an outer appearance identical to that of conventional trousers, shorts etc. However none of them quite succeed in this attempt. Smith & Smith fail to devise an appropriate means of concealing the zipper pulley of a concealed-zip when closed; Stradley's covering means of the fastener do not lie flat properly if non-top-stiched (as implied), or if top-stiched they give a different outer appearance than conventional articles of that type that do not have a crotch fly. Similarly Pasquier's double-channel coverings face the same problem as Stradley's, and her single-channel covering gives the distinct outer appearance of an extended (top-stitched) front fly placket from the front waist through the rear waist.

In what follows the term 'perineum' is used to describe a surface region of a female body extending from a region in front of the genital organs back through the crotch to the region of the anus.

Concealment of an all-the-way-around crotch opening is a different task from that of the concealment of a long crotch opening. The long crotch opening affects the appearance of the front of the trouser differently from one whose fastening means extends as far as the front waist. Similarly, concealment of a short (perineal) crotch opening is yet a another different task, the short opening affecting the appearance of the rear of the trouser differently from one whose fastening means extends as far as the rear waist.

Pietralunga (AU-40086/93) discusses a short crotch opening (one that extends along the perineum); and when a zip/buttons are used the fastening means lie exposed (i.e. unconcealed). Similarly Gregorio (WO-93/13679). However neither Pietralunga nor Gregorio attempts concealment or even covering of the exposed zip/button fastening means (despite the obvious advantages of such concealment).

Whether the crotch zip is short (extending along the length of the perineal region) or long (extending as far as the rear waist) the tension that is created between the legs when the legs are spread apart as for urination remains the same. However, in the open position of the shorter crotch zip there is achieved a natural drawing apart of the two sides of zip as the legs are spread that is both wider and more taut at the central point of the short crotch zip. In the open configuration of the longer zip the tension is dispersed along the whole length of the zip and is therefore proportionately less along any given point along its length.

With the greater tension generated along the open sides of the shorter zip the shorter zip is less prone to zip jamming, and the sliding of the zip pulley is rendered smoother and easier to use as well as being quicker to open and close owing to the shorter length of the zip.

The limited extent of the shorter crotch fly means that the garment still feels like a pair of trousers even when the fly is open and enhances the acceptability of the garment to wearers. Psychologically it may seem distasteful for women to wear garments that are designed for defecation as well as urination. Further the full opening of the longer crotch zip may result in undesirable disarrangement of clothes at the rear end that would otherwise have remained tucked in, disarrangement which can be avoided with the shorter crotch zip.

The present invention discloses several different ingenious means of concealing a short crotch opening in jeans, classics trousers, shorts, casual bottoms etc. sufficiently well in designs both with and without a front fly so as to give the outward appearance or illusion along both the front and rear views of the article as of a conventional garment of that type.

For example:

(1) an article of conventional jeans finish provided with a regular short crotch zip [along the perineal region] that is covered by a narrow flap that is double top-stiched and which continues in its extent as far as the rear waist and which is permanently attached to the sides of the garment along the line between the rear end of the crotch zip and the rear waist and whose outer (folded) edge is unattached to the corresponding panel of the garment along the length of the perineum, thereby leaving the perineal zip full accessible yet concealed when the garment is worn and the zip is closed; such flap typically being wider than the 'ridge-seam' along the crotch and rear seam line of conventional jeans but nevertheless giving the outer appearance or illusion when it is worn of a conventional ridge-seam even along that part of its extent in the crotch where its outer edge is unattached to the panel of the jean and that covers the regular zip;

(2) classics trousers, jeans, shorts and casual bottoms etc. with a concealed/invisible crotch zip of which at least one side deviates at one end so as to achieve a concealment of the pulley of the zip when closed and with the illusion of a closed seam along the deviating extent of the zip;

(3) a number of different reinforced and non top-stiched flap concepts using a regular zip in classics trousers, short and casual bottoms etc. e.g. non top-stiched but reinforced with special tape/heat adhesive interfacing that ensures that the flap lies flat and gives the appearance of a normal seam when the zip is closed, and with the outer edge of the flap merging at its rear with the rear seam giving the appearance at the back of a continuous closed seam, and similarly at the front where there is no front fly, or alternatively merging with the outer edge of the front placket as does a conventional crotch seam; also double-channel reinforced flaps; all of which ingeniously give the outer appearance of a single conventional seam along the crotch when the trouser is worn.

In what follows a crotch fly that is said to extend along the perineal region, or perineum, is a crotch fly that embodies a releasably retainable aperture means whose extent is typically of between 7 and 10 inches in length, of which between 3 and 4 inches lies to the frontal end of the 'apex' of the garment and between 4 and 6 inches lies to the rear; 1 inch=2.54 cm.

The term 'apex' refers to the point along the perineal region within a conventional pair of trousers, shorts, slacks, etc. where the four seams of the garment (i.e. the frontal, rear and inside seams) converge towards or meet. In what follows the term 'apex' is used to describe a region that is the equivalent in women's jeans, classic trousers, shorts, casual bottoms etc. that are provided with a crotch fly (i.e. the point of converging or meeting of the fastening means of the crotch fly, when closed, with the two inside seams of the garment).

According to a first aspect of the invention, there is provided an article of clothing having a crotch portion separating two leg portions or openings, and having in the crotch portion a crotch fly extending along the perineal region, the crotch fly being openable and closable by fastening means which in the closed position are concealed, and in which, preferably, the said fastening means are provided along a line in the crotch portion in such a manner as to give the appearance of a normal stiched seam in the closed position.

According to a second aspect of the invention, there is provided an article of clothing which is as claimed in claim 2.

The fastening means preferably comprise an ordinary zip; an invisible zip; or buttons and corresponding button holes.

The fastening means may be concealed behind a flap of material provided with a stitching line or lines forming an extension of and/or simulating a seam stitching line or lines at the front and/or rear of the article of clothing.

In the case of a zip, it may be advantageous for the zip to extend along or parallel to the said line but to be arranged at one end at least to deviate away from the said line. In this instance a widened flap portion or portions may be provided for covering said at least one end and for concealing an enlarged end portion of the zip. Advantageously, in one embodiment, there are two widened flap portions which create an open seam having edges arranged to follow the said line when the zip is closed.

Alternatively, the zip may extend along or parallel to the seam line and a widened flap portion having an edge deviating beyond the said line may be provided on at least one side and at one end at least of the zip for concealing an enlarged end portion of the zip.

Said one end at least of the zip may be arranged to deviate on only one side of the zip or on both sides.

The present invention discloses an article of women's jeans, classics trousers, shorts, casual bottoms etc. with a crotch fly and with further concealment means of the said fly as follows:

(i) with a narrow facing of material permanently attached at one side to, or being a continuation of, one of the sides of the garment and, preferably, attached along its other side to the other of the sides of such garment by releasably retainable means (e.g. buttons, poppers etc.); such facing typically being of a length and width and being so positioned so as to just and yet completely cover the zip pulley of the fastening means of the crotch fly when such facing lies flat onto the sides of such garment and the fastening means of the crotch fly is in its closed configuration;

(ii) with a narrow facing of material permanently attached on both sides to, or being a continuation of, both of the sides of the garment respectively, the pulley of the crotch zip being drawn beneath such facing as such fastening means of the crotch fly is being closed;

(iii) where the facing is folded over at least one side to form a facing of double-thickness material over at least a part of the extent of such facing with a closed edge(s) provided along the foldover line(s);

(iv) with a separate faced-in material piece attached to the underside or exterior side of the facing as provided and extending over at least a part of the extent of such facing;

(v) with one or more faced-in material pieces and/or folded-over faced-in pieces attached to underside and/or the exterior side of the facing as provided.

(vi) with material facing that is attached to or is a continuation of either of the sides of the garment along the length of the fastening means of the crotch fly so as to cover such fastening means when closed. When the garment is worn and the fastening means is closed, the facing typically rests flat onto the sides of the garment and at its outer edge creates an open apparent seam line that gives the outer appearance or illusion of a conventional closed seam that continues from the line of the closed front seam and is followed by the line of the closed rear seam;

(vii) with the material facing as provided being folded over forming a folded edge, with the facing now of double-thickness over at least a part of its extent owing to the double layer of (folded) material of which it is formed along such extent;

(viii) with a separate faced-in material piece attached on the underside of the facing/folded-over facing as provided and extending over at least a part of the extent of such facing;

(ix) with one or more faced-in material pieces and/or folded-over faced-in pieces attached to underside of the facing/folded-over facing as provided, each of which faced-in piece(s) extending over at least a part of the extent of the facing/folded-over facing as provided.

(x) with an inverted zipper provided as the fastening means and with material facing that is typically of width so as to just and yet completely cover the apparent seam created by the means of the inverted zipper when in the closed configuration;

(xi) where the complementary part of the fastening means of the crotch fly that is attached to the panel of the garment that embodies the facing as provided deviates at its upper frontal and/or rear end(s) from its alignment parallel to the contour of the apparent seam-line that is created when such facing lies flat onto the sides of the garment so as to create a triangular 'lip'(s) that accommodates an exaggerated concealment of such upper and/or rear end(s) of such fastening means when in the closed configuration; (movement of the pulley of the zip may be provided either from front to rear or from the rear to the front of the article;)

(xii) with material facings that extend from (or are a continuation of) both sides of the garment along the length of the fastening means of the crotch fly such that when the garment is worn and the fastening means is in its closed configuration, the facings typically rest flat onto the sides of the garment and their outer edges meet or overlap to create an open seam line that gives the outer appearance or illusion of a conventional closed seam that continues from the line of the closed front seam and is followed by the line of the closed rear seam;

(xiii) where either or both of the complementary parts of the fastening means of the crotch fly deviate at their upper frontal and/or rear end(s) from their alignment parallel to the contour of the apparent seam-line that is created when such facing(s) lie flat onto the sides of the garment so as to create a triangular 'lip(s)' that each accommodate an exaggerated concealment of such upper and/or rear end(s) of such fastening means when in the closed configuration;

(xiv) where either or both of the complementary parts of the fastening means of the crotch fly deviate at their upper frontal and/or rear end(s) from their alignment parallel to the contour of what would have been the conventional seam-line of such garment in the absence of such crotch fly so as to create a triangular 'lip(s)' that each accommodate an exaggerated concealment of such upper and/or rear end(s) of such fastening means when in the closed configuration;

(xv) with material facing(s) that extend as far as the rear waistband of such garment;

(xvi) with a stitching line or lines on the material facing(s) so as to give such facing(s) the appearance of a 'ridge-seam' as is conventional along the central seam-line of trousers, shorts, slacks etc. of a typical jean-out or jean-finish; (such a stitching line or lines facilitates such a garment to retain the outward characteristics of a standard garment of jean-cut and as if without a crotch fly when such a garment is worn, there being a confusion in appearance between the material facing of such a garment, as such facing lies flat onto the sides of the trouser when worn, with the (sewn down) 'ridge-seam' of garments of jean-cut or jean-finish).

(xvii) where the outer edge of the single material facing as provided is along an extent of the upper and/or rear end(s) of the crotch fly permanently attached to the corresponding panel of such garment, forming a closed as opposed to open seam-line covering such upper and/or rear end(s) of the crotch fly;

(xviii) where the two material facings as provided are permanently attached along an extent of the upper and/or rear end(s) of the crotch fly along the line of the meeting (or crossing or along an extent of the overlapping part) of their outer edges, forming a closed as opposed to open seam-line covering such upper and/or rear end(s) of the crotch fly. Typically (but not exclusively) the closed seam-line is provided at the top-most end of the crotch fly continuing from the closed front seam and/or the rear-most end of the crotch fly that is followed by the closed rear seam;

(xix) with at least one of the complementary parts of the fastening means attached to the interior of the sides of the garment along the length of the perineum such that when such garment is worn and such fastening means are in the closed configuration the exterior sides of the garment typically meet or overlap to cover the fastening means of the crotch fly and create an open seam line along the length of the perineum that gives the outer appearance or illusion of a conventional closed seam that continues from the line of the closed front seam and is followed by the line of the closed rear seam;

(xx) with either or both of the sides of the garment folded over along the length of the perineum to form at least one folded edge along the length of the perineum; at least one side of the fastening means is attached on the underside of the fold, such that when the fastening means is in the closed configuration at least one of the complementary parts of the fastening means lie on the interior of the garment and the edges of the sides of the garment typically meet or overlap to cover the fastening means of the crotch fly and create an open apparent seam line along the length of the perineum that gives the outer appearance or illusion of a conventional closed seam that continues from the line of the closed front seam and is followed by the line of the closed rear seam;

(xxi) with material facing(s) that are attached to at least one of the sides of the garment along the length of the perineum; at least one side of the fastening means is attached to the exterior of the respective facing along the length of the perineum. The facings are attached in such a way that when the fastening means is in the closed configuration a closed and folded edge forms along the line of attachment of the respective facing and the facing folds over to the underside/interior of the garment such that the sides of the garment meet or overlap at the folded edges so as to cover the fastening means of the crotch fly and create an open (apparent) seam line along the length of the perineum that gives the outer appearance or illusion of a conventional closed seam that continues from the line of the closed front seam and is followed by the line of the closed rear seam;

(xxii) with one or more separate faced-in material pieces and/or folded-over faced-in pieces attached to the underside of either or each of the fold(s) or side(s) of the garment as provided and along the length of the crotch fly and the fastening means attached on the underside of the faced-in piece;

(xxiii) where either or both complementary parts of the fastening means of the crotch fly deviate from their alignment, parallel to the contour of the line of meeting or crossing of the two sides/closed edges of the garment when the crotch fly is in its closed configuration, at their upper frontal and/or rear end(s) so as to create triangular 'lip(s)' that accommodate an exaggerated concealment of such upper and or rear end(s) of such fastening means when in the closed configuration;

(xxiv) with such a stitching line or lines on one or both of the sides of the garment that meet or overlap along the length of the perineum affording to exterior of such garment along such length of stitching the appearance of a 'ridge-seam' as is conventional along the central seam-line of trousers, shorts, slacks etc. of a typical jean-cut or jean-finish;

(xxv) where the exterior sides of the garment (or closed edges) form an open seam along the length of the crotch fly except at the upper and/or rear end(s) of such crotch fly where the sides of the garment (or closed edges) are permanently attached along the line of their meeting or crossing so as to form a closed seam covering such upper and/or rear end(s) of the crotch fly;

(xxvi) having a crotch fly extending along the perineal region and along the contour of what is otherwise the central seam-line of the garment and attached to the exterior or edge periphery of the sides of the garment except at the upper and/or rear end(s) of the crotch fly at the front of the garment where the fastening means of the crotch fly deviate from the conventional seam-line so as to create triangular 'lips' for concealment of the upper and/or rear deviating end(s) of the fastening means of the crotch fly when in the closed configurations, with a rear seam provided between the rear end of the crotch fly and a rear waistband of the garment, such upper and/or rear deviating end(s) of the sides of the fastening means attached on the underside/interior of the sides of the garment;

(xxvii) with extra material facings that are a continuation of the each of the sides of the garment at the upper and/or rear deviating end(s) of the crotch fly, and onto which facings the upper and/or rear end(s) of the fastening means of the crotch fly deviate and are attached. When such fastening means are in the closed configuration the facings at the upper and/or rear deviating end(s) of the crotch fly fold over to the underside/interior of the sides of the garment and there is provided folded edges that meet (or overlap) so as to cover the fastening means of the crotch fly and create an open seam line along the extent of the upper and/or rear deviating end(s) that gives the outer appearance or illusion of a conventional closed seam that continues from the line of the closed front seam and/or is followed by the line of the closed rear seam respectively;

(xxviii) extra material facings that are attached to each of the sides of the garment at the upper and/or rear end(s) of the crotch fly, and the upper and/or rear end(s) of the fastening means of the crotch fly deviating and being attached to such facings. When such fastening means are in the closed configuration the separate material pieces that are attached to the sides of the garment at the upper and/or rear end(s) of the crotch fly fold over to the underside/interior of the sides of the garment and there is provided folded edges that meet (or overlap);

(xxix) with one or more separate faced-in pieces and/or folded-over faced-in pieces attached to underside of either or both of the sides or folded-over sides or facings or folded-over facings as provided and along the length of the deviating end(s), with the fastening means attached along such extent of the deviating end(s) to the underside of such separate facing;

(xxx) with a front seam extending from the front waistband of the garment to the upper end of the crotch fly and a rear seam extending from the rear end of the crotch fly to the rear waistband of the garment, either or both of which is/are unconventional (and new) in that it/they embodies a more accentuated and outward curvature than is standard, with extra material provided to that side of the garment that embodies the exaggerated convex (curved) frontal and/or rear seam, and with further extra material provided also to the same side of the garment towards the region of the upper frontal and/or rear end of the crotch fly, creating a wider (and longer) 'lip' providing a more exaggerated concealment of the upper and/or rear deviating end(s) of the fastening means of the crotch fly when in the closed configuration;

(xxxi) with either or both deviating upper frontal and/or rear ends of the fastening means of the crotch fly deviating from their alignment parallel to the line of meeting or crossing of the two sides/closed edges of the garment when the crotch fly is in its closed configuration yet not deviating as such from the contour of the otherwise conventional seam-line of such garment in the absence of the crotch fly. The exaggerated outward curvature(s) of the frontal and/or rear seam(s) as provided creates a sufficiently exaggerated 'lip(s)' such that the fastening means of the crotch fly when in the closed configuration falls on the underside of the lip(s) at its upper frontal and/or rear ends without such fastening means deviating as such (when closed) in its path from the contour of what would otherwise in the absence of the crotch fly have been the conventional central seam-line of such garment;

(xxxii) with a closed seam (as opposed to open seam-line) along an extent of the upper frontal and/or rear end(s) of the crotch fly (via a permanent attachment of the two sides/closed edges of the garment along such extent) that covers such extent of the upper frontal and/or rear end(s) of the crotch fly. Preferably the closed seam is provided at the top-most end of the crotch fly continuing from the closed front seam and/or at the rear-most end of the crotch fly continuing from the closed rear seam;

(xxxiii) with a placket depending from the said waistband and covering the front seam/front fastening means (such fastening means comprising zipper means or buttons or other fastening means that are known) of the garment, such placket otherwise being as of conventional plackets that are found in trousers, shorts, slacks etc. that are provided with a front fly. The placket as provided extends towards the crotch fly but is spaced from the crotch fly, the sides of the garment being held together at the junction between the placket and the crotch fly;

(xxxiv) with a front placket that is non-conventional (and new): the lower end of such placket covers an upper part of the fastening means of the crotch fly (or a 'lip' or facing or upper part of any facing covering an upper part of the fastening means of the crotch fly when in the closed configuration as provided in such claims as above) when such crotch fly is in the closed configuration and such placket lies flat onto the sides of such garment; (stitching/bar-tac reinforcement as is standard in front fly plackets at the point where the base of the placket meets the outside edge of such placket is displaced);

(xxxv) with a front placket which when lying flat onto the sides of such garment covers also any apparent seam-line that is created along the meeting or overlapping edges along the upper end of such crotch fly where one or both of the complementary sides of the fastener means deviate creating a lip(s) on either or both sides of such garment at the upper deviating end(s) of such crotch fly;

(xxxvi) with a placket whose outer edge (when lying flat onto the sides of the garment) at its lower end extends precisely along the same contour as of the closed edge (or apparent seam-line) of the same side of the garment along the extent of an upper end of such crotch fly where one or both of the complementary sides of the fastener means device creating a lip(s) on either or both sides of such garment at the upper deviating end(s) of such crotch fly;

(xxxvii) as in the above embodiment where the side of the garment is, along the extent of the closed edge or apparent seam-line that is provided, permanently attached to the underside of such placket as provided;

(xxxviii) where that side of such garment that falls under the outer edge of such placket (as it lies flat onto the sides of such garment) is, along an extent parallel to the length of the front seam/front fastening means, permanently attached to the underside of such placket;

(xxxix) with a placket that extends along the full extent of the crotch fly and whose outer edge covers the fastening means of the crotch fly when in the closed configuration (or any such apparent seam-line as is created by the provision of a fastener of concealed-zip means) when the placket lies flat onto the sides of such garment. Typically the placket becomes noticeably narrower in its width along the extent of the crotch fly that lies below its upper deviating end;

(xl) with a placket that extends along the full extent of the crotch fly and whose outer edge covers the fastening means of the lower non-deviating end of the crotch fly when in the closed configuration (or any such apparent seam-line as is created by the provision of a fastener of concealed-zipper means) when the placket lies flat onto the sides of such garment. Typically such placket becomes noticeably narrower in its width along the extent of the crotch fly that lies below its upper deviating end;

(xli) with a placket that extends along the full extent of the crotch fly and whose outer edge at its lower end runs adjacent to and yet does not cover the line of the fastening means of the lower non-deviating end of the crotch fly when in the closed configuration (or any such apparent seam-line as is created by the provision of a fastener of concealed-zipper means) when such placket lies flat onto the sides of such garment. Typically such placket becomes noticeably narrower in its width along the extent of the crotch fly that lies below its upper deviating end;

(xlii) with a placket that extends along the full extent of the crotch fly and whose outer edge at its lower end does not cover the line of the fastening means of the lower non-deviating end of the crotch fly (or any such apparent seam-line as is created by the provision of a fastener of concealed-zipper means) yet covers the actual line of or the apparent seam line that is created by the upper deviating end of the crotch fly when in the closed configuration when such placket lies flat onto the sides of such garment. Typically such placket becomes noticeably narrower in its width along the extent of the crotch fly that lies below its upper deviated end;

(xliii) where the placket as provided extends beyond the region of the rear end of the crotch fly, and as far as a region towards the rear waistband of such garment along the contour (or thereabouts) of what is otherwise the rear seam of such garment;

(xliv) with a placket which when lying flat onto the sides of such garment covers the front seam/front fastening means of such garment, and of which (placket) the line of its outer edge as its base end is followed in a continuous path by the line of the outer edge of such apparent seam-line as is created as the covering means of the fastening means of the crotch fly lies flat onto the sides of the garment and the crotch fly is in the closed configuration;

(xlv) with a placket which when lying flat onto the sides of such garment covers the front seam/front fastening means of the garment and an upper part of the frontal end of such apparent seam-line as is created as the covering means of the fastening means of the crotch fly lies flat onto the sides of such garment and such crotch fly is in the closed configuration, and of which the line of its outer edge at its base end merges in a continuous path with such apparent seam-line as is present along the remaining extent of the crotch fly (when closed) that is uncovered by such placket and that extends beyond the base of such placket;

(xlvi) with covering means of the crotch fly that is along the upper end of one side of the apparent seam-line as provided when such fastening means of the crotch fly is closed (i.e. that side of the covering means of the crotch fly that extends from the same panel of the garment as does the placket as provided) permanently attached to the corresponding region of the underside of the placket as provided;

(xlvii) with covering means of the crotch fly that is along the contour of the top end of one side of the apparent seam-line as provided when such fastening means of the crotch fly is closed (i.e. that side of the covering means of the crotch fly that extends from the same panel of the garment as does the placket as provided) permanently attached to the corresponding extent of the adjacent base end of such placket;

(xlviii) with a placket that when lying flat onto the sides of such garment covers the front seam/front fastening means of the garment and the full length of such apparent seam-line as is created as the covering means of the fastening means of the crotch fly lies flat onto the sides of such garment and such crotch fly is in the closed configuration. Typically such placket becomes noticeably narrower in its width along the extent of the crotch fly;

(xlix) with a placket that when lying flat onto the sides of the garment covers the front seam/front fastening means of the garment, and extending along the full length of such crotch fly the line of its outer edge along the extent of the crotch fly falls precisely along the same line as such apparent seam-line of the crotch fly (when closed). Typically such placket becomes noticeably narrower in its width along the extent of the crotch fly;

(l) with a placket that when lying flat onto the sides of such garment covers the front seam of such garment, and extending along the full length of such crotch fly the line of its outer edge along the extent of the crotch fly falls parallel to but does not cover or meet such apparent seam-line of the crotch fly (when closed). Typically such placket becomes noticeably narrower in its width along the extent of the crotch fly.

(li) where the side of the garment that falls under the outer edge of the placket is permanently attached to the underside of the placket along its upper end that covers the front seam;

(lii) where that side of the garment (or material facing thereabouts) is along the full length of the crotch fly permanently attached to the underside of such placket;

(liii) with the 'lip' as provided (as the covering means of an upper deviating end of one of the sides of the fastening means of the crotch fly when such crotch fly is closed) being the continuation of a placket that is provided that when lying flat onto the sides of such garment covers the front seam/front fastening means: (the lip and placket as provided comprise one and the same 'placket');

(liv) with the covering means of the fastening means of the crotch fly (when closed) as provided at one of the sides of such garment being the continuation of a placket that is provided at the same side of such garment that when lying flat onto the sides of the garment covers the front seam; (the covering means and placket is provided comprise one and the same 'placket');

(lv) where that side of the garment that falls under the outer edge of a placket [as it lies flat onto the sides of such garment] is, along an extent parallel to the length of the front seam/front fastening means, permanently attached to the underside of such placket;

(lvi) an article with releasably retainable fastening means (e.g. zipper means, buttons, VELCRO hook-and-loop fasteners etc.) depending from the said waistband and along the contour (or thereabouts) of what is otherwise the front seam of such garment, the base end of such fastening means (when closed) being:

(a) spaced vertically at a distance from the upper end of the fastening means of the crotch fly (when closed);

(b) spaced horizontally at a distance from the upper end of the fastening means of the crotch fly (when closed);

(c) running alongside and adjacent to the upper end of the fastening means of the crotch fly (when closed);

(d) running directly above (or on top of) the upper end of the fastening means of the crotch fly (when closed);

(e) running directly below the upper end of the fastening means of the crotch fly (when closed);

(lvii) an article as in any of the preceding aspects that is provided with a 'placket' that is provided also with top-stitching along that side of the garment to which such placket is applied that runs vertically and parallel to the outer edge of such placket until it then runs in a curved line tending horizontally towards such outer edge at the base of the line of such top-stitching, and such top-stitching provides a notional inner boundary to such placket as provided;

(lviii) where the top-stitching as provided also comprises a line of stitching that attaches the underside material or foldover [or a part of such underside material or foldover] of the placket to the corresponding side of such garment;

(lix) where the top-stitching as provided also comprises a line of stitching that attaches the underside material or foldover (or a part of such underside material or foldover) of the placket to the corresponding side of such garment, except at the base of the line of such top-stitching where such placket is not permanently attached to the corresponding side(s) of such garment;

(lx) with fastening means of the crotch fly provided that extend as far as the region of the rear waistband of such garment;

(lxi) with respect to front plackets that extend over or along a part of the crotch fly but do not extend over or along the full length of the crotch fly:— in which any standard permanent means of attachment of the two sides of the garment at the base of the placket as provided is removed and displaced to a region vertically above this and further towards the top end of the fastening means of the crotch fly;

with one or more releasably retainable means of attachment (e.g. poppers) at the base of such placket;

with one or more releasably retainable means of attachment (e.g. poppers) provided in a region vertically above the previous point of permanent attachment at the base of such placket and further towards the top end of the fastening means of the crotch fly;

(lxii) with respect to front plackets that extend over or along (or beyond) the full length of the crotch fly:— with permanent means of attachment of the outer edge of the placket to the corresponding panel of such garment applied at a region towards the top end of the fastening means of the crotch fly;

with releasably retainable means of attachment (e.g. poppers) of the outer edge of the placket to the corresponding panel of such garment applied at a region towards the top end of the fastening means of the crotch fly;

with one or more releasably retainable means of attachment (e.g. poppers) of the outer edge of the placket to the corresponding panel of such garment applied intermittently along the remaining lower extent of the placket;

(lxiii) bar-tacks or other means of reinforcement at the rear end of the fastening means of the crotch fly that reinforces the strength of the stitching in that region;

(lxiv) with bar-tacs or other means of reinforcement provided at the rear end of the fastening means of the crotch fly that prevent avoidable wear and tear of the material in that region of the garment;

(lxv) with inner facing(s) attached to the interior of either or both of the sides of such garment along the line of the edges or closed edges (or seam-line) as provided and extending from the region of the front waistband and to a region not beyond the apex of such garment;

(lxvi) with inner facing(s) attached to the interior of either or both of the sides of such garment along the line of the edges or closed edges (or seam-line) as provided and extending from a region towards the upper end of the crotch fly and to a region not beyond the apex of such garment;

(lxvii) with inner facings extending beyond the region of the apex of such garment that are sufficiently narrow beyond this apex region so as not to impede the clean efflux of bodily fluids from the open crotch access opening;

(lxviii) with inner facings extending beyond the region of the apex of such garment that are sufficiently narrow beyond this apex region so as avoid risk of the undesirable catching of the inner facing(s) between the zipper teeth and the zipper pull of the crotch fly when the zipper means of the crotch fly is in regular use;

(lxix) with fastening means of the crotch fly that comprises zipper or inverted zipper means, provided with closing means of such fastening means that is achieved by a movement of the zipper pull in the direction from the rear to the frontal end of such fastening means; or in a direction from the frontal end to the rear of such fastening means;

(lxx) with fastening means of the crotch fly and fastening means of the front fly that comprise one single zip or inverted zip means;

(lxxi) with two sets of zipper-pulls along the single set of zipper teeth as provided;

(lxxii) with a means of discontinuity (e.g. a metal or plastic 'stop') provided along the single set of zipper teeth with the zipper-pulls that are attached to the zipper teeth being separated in their movement by such means of discontinuity as provided. Typically such means of discontinuity is applied at a region towards the upper frontal end of the perineum as defined;

(lxxiii) as in any preceding embodiment that is provided with a placket, with such a 'placket' that is unconventional (and new) in that the placket is a single facing of material;

(lxxiv) provided with such a 'placket' that is unconventional (and new) in that the placket is a single facing of material that is folded over at its outer edge providing a 'placket' constructed of double-thickness facing over at least a part of its extent.

Various embodiments of the invention will now be described, by way of example only, with reference to the accompanying drawings; in which.

Figures 17A, 17B:
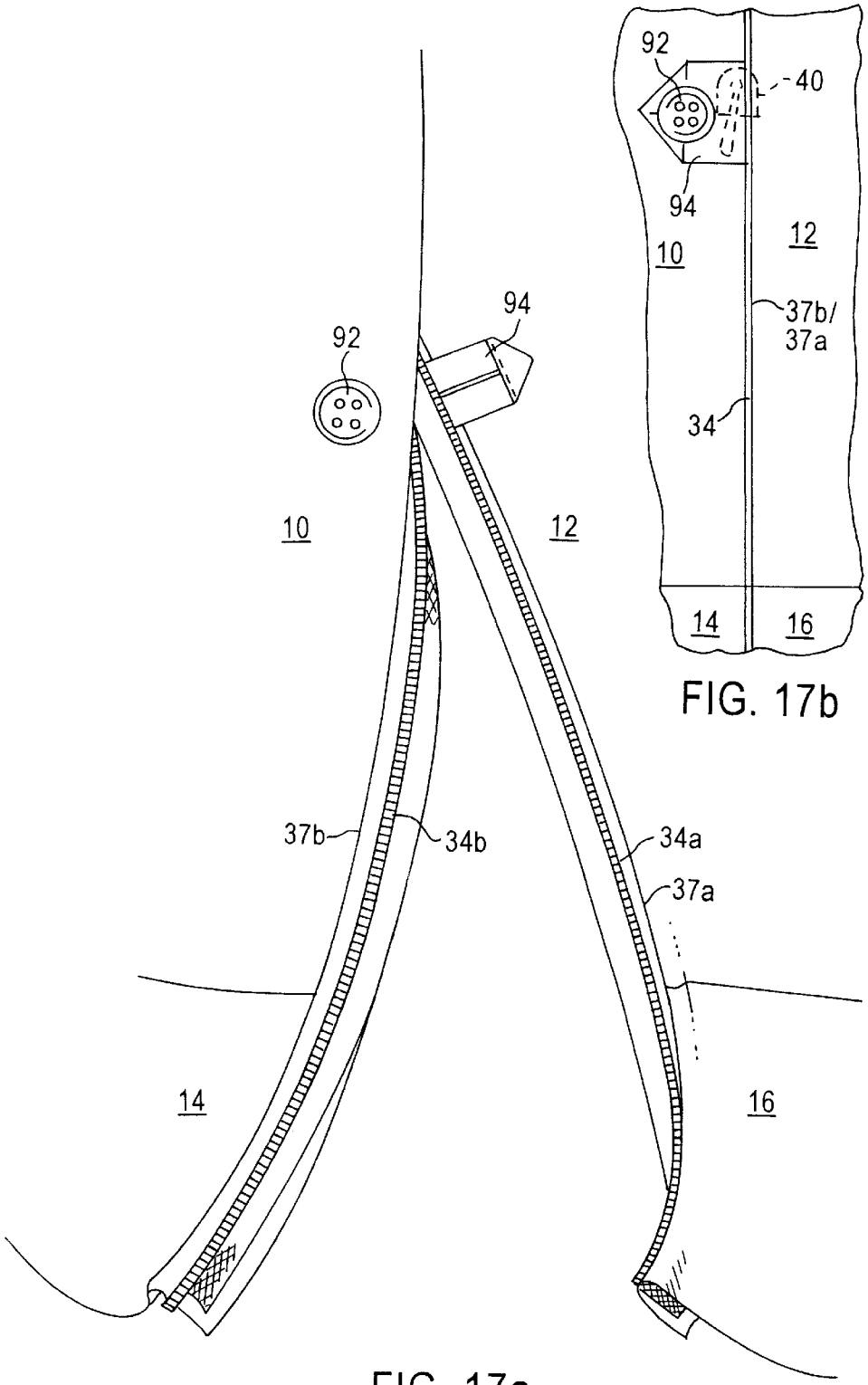

FIGS. 17*a* and 17*b* are views of the front upper part of a further form of lady's classic trousers in which there is a crotch fly with no front fly.

Figure 1:
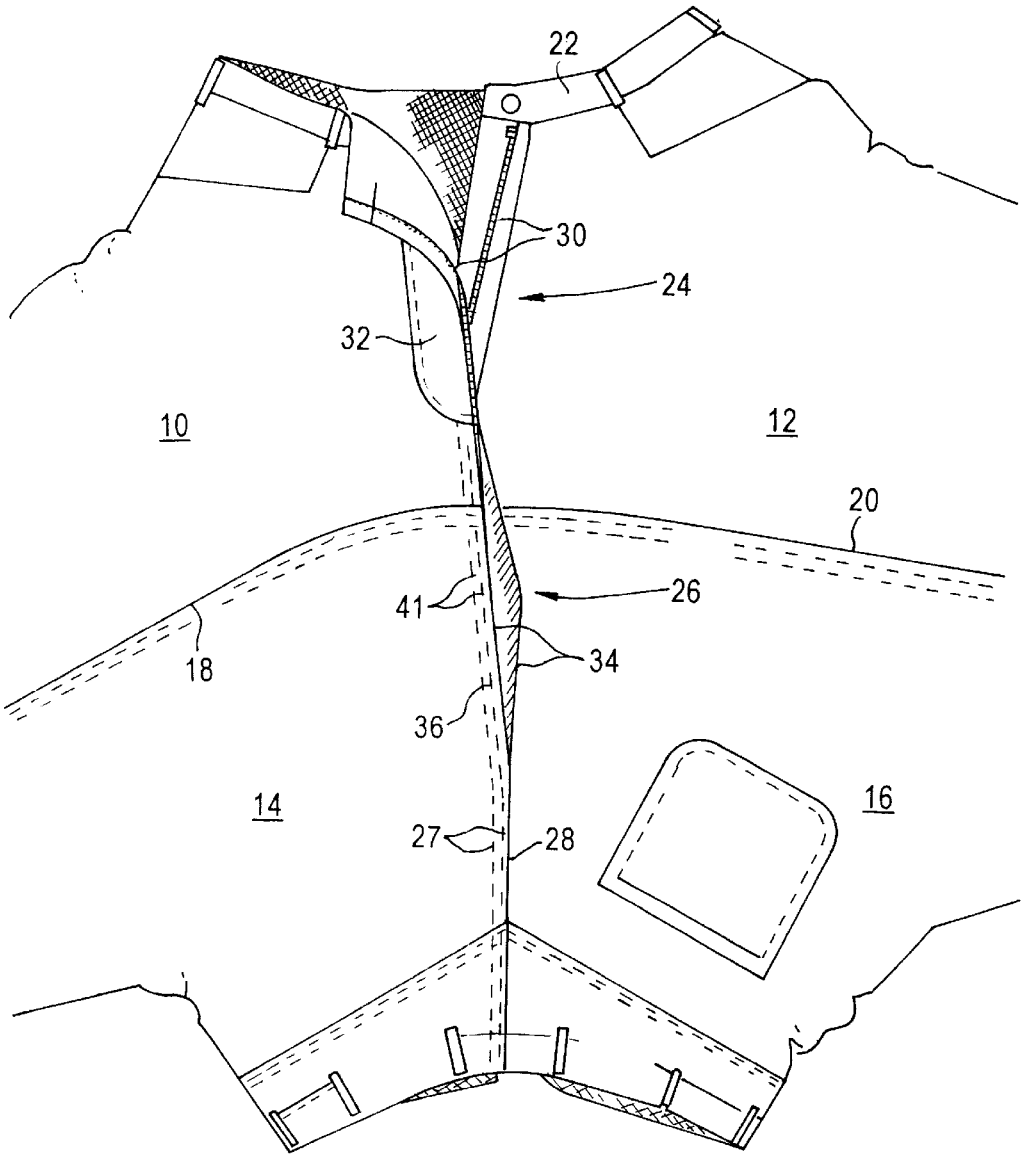
FIG. 1 is a view from the outside of an embodiment of the upper part of a pair of lady's jeans with the side seams not fastened and with the jeans laid flat.

In FIG. 1 there is shown the upper part of a pair of trousers of a jeans cut comprising left and right front leg panels 10,12, and left and right rear leg panels 14,16 that meet at inside leg seams 18,20 and a waistband 22. The trousers are formed with a front fly 24 and a crotch fly 26. The front fly 24 may typically have a length of about 18–20 cm (7–8") and the crotch fly 26 typically has an extent of about 18–26 cm (7–10") and has an extent and position corresponding to the female perineum, the two fly openings being located one following the other as shown. Behind the crotch fly 26 there is a rear seam portion 28 which extends to the rear part of the waistband 22. The length of the crotch fly 26 has been adopted so that opening is limited to the perineal area e.g. for urination. When the wearer is in a position with her legs spread as for urination, the lateral tension is concentrated in the region of the garment between the legs which is where the crotch zip is located, so that tension tends to open the fly 26 in a natural way when it is unzipped, which helps to avoid unintended soiling of the trousers.

The front fly 24 has a zip fastener 30 concealed by a placket 32. The crotch fly 26 has a second zip fastener 34 which opens by moving its pulley towards the rear seam 28 and closes by the reverse movement. The zip fastener 34 when closed is concealed behind the flap 36 which is attached to the marginal edges of panels 14 and 10. This flap 36 and the top stitching 41 has substantially the same appearance as the raised rear seam 28 and the top stitching 27 along the length of the rear seam when the flap is covering the closed crotch zip. The flap 36 and its top-stitching 41 will be hereafter referred to as a "ridge-seam", and is typically formed of double-folded material. Alternatively the flap 36 may be attached to the marginal edges of panels 12 and 16 so as to give a similar outward appearance when covering the closed crotch zip.

To improve the effectiveness of the concealment of the pulley of the crotch zip when it is closed, the following measures can be taken:

(i) Flap 36 can be designed as slightly wider towards that end of the crotch fly where the zip rests when the crotch fly is in the closed position.

(ii) One side of the zip teeth of the crotch zip deviate slightly further towards the inside edge of the flap 36 (than the remaining extent of the zip is) so as to lead the pulley of the zip further towards the inside edge of flap 36 when the zip is in the closed position.

(iii) Where the pulley of the crotch zip rests when the zip is in the closed position, in that particular flap 36 can be permanently attached to the opposing panel of the trouser so as to create a permanently closed raised seam over an upper part of the pulley of the zip. It is important however that the closed seam does not cover the pulley completely and there is an open seam over at least a partial extent of the pulley (when the zip is closed) so that the pulley can be readily accessed by the wearer of the garment.

Alternatively there need be no front fly 24 with other means e.g. side zips, elasticated waist etc. for removal of the garment.

Typically the flap 36 (bounded on one side by the line of its inner line of top-stitching and on the other side by its outer folded edge) is of a similar width to the raised rear seam 28, the raised rear seam typically being a continuation of the flap 36 except that it is permanently attached to the sides of the jean along both its parallel edges. The raised rear seam provided here is preferably of a similar width and outer appearance to the conventional raised rear seam of a standard pair of jeans.

Alternatively flap 36 may be formed of material that is folded at an edge along which is attached (or 'faced in') a separate material piece that is also folded along an edge, such edges of the opposing material pieces being attached together and forming a flap of double thickness (or quadruple thickness along the extent of the line of the folded edges). The attachment of such a separate 'faced in' material piece not only provides an outer edge to flap 36 that is sharper than that formed by a flap of single folded material, but the separate 'faced in' material piece also helps the flap 36 align better to the curved contour of the fastening means or seam line in the crotch region.

Figure 2:
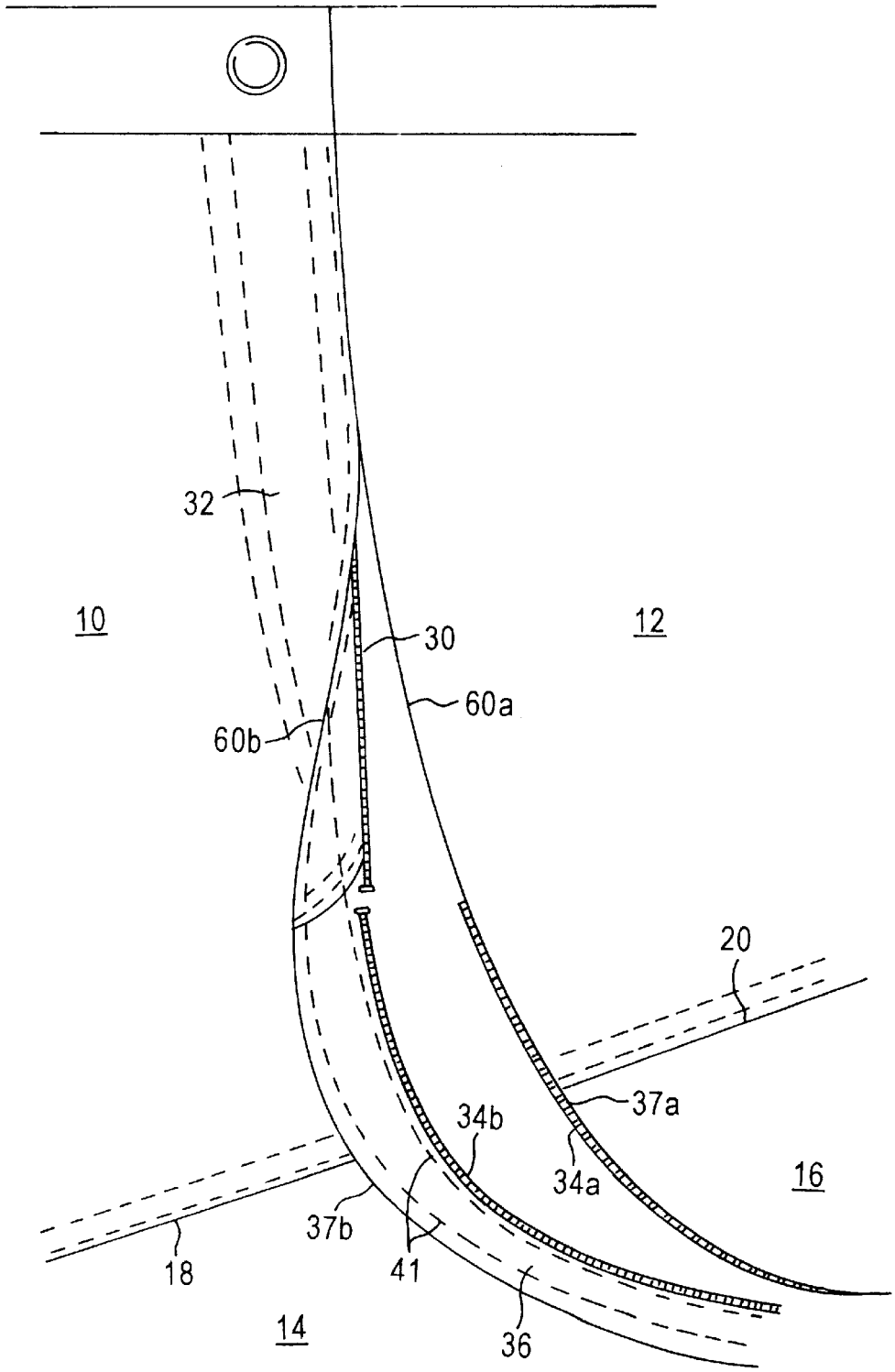
FIGS. 2 and 3 are views of the front upper part of another form of jeans cut trousers showing the outer and inner faces respectively.

In FIG. 2 there is shown part of a pair of trousers like that in FIG. 1 with the teeth 34*a* of one side of the zip fastener 34 coinciding with the edge of panels 12,16 and with the teeth 34*b* at the other side located at one side of the flap 36. With this arrangement the zip fastener and its pulley are concealed by the flap 36, when the zip is closed as in FIG. 3, which has the appearance of a ridge seam, so that there is little difference in appearance between the present garment and jeans of conventional construction. This similar appearance is enhanced by the continuous path of the top-stitching which begins in the upper placket (69) and continues over the flap 36 in closed position (41) and which further continues along the top-stitching 27 of the raised rear seam. Edge 60*a* follows in a continuous path from edge 37*a*, and are the edges of panels 12 and 16 respectively. Similarly edges 60*b* and 37*b* follow in a continuous path, are the edges of panels 10 and of the flap 36 attached to panel 14 respectively. An analogous arrangement of edges can be envisaged when the flap 36 is attached to the panels 12 and 16. When the crotch fly is closed as in FIG. 3 the edges 60*b* and 37*b* typically overlap edges 60*a* and 37*a* as depicted. The internal construction of the garment is apparent from FIG. 3 where the pulley 40 of the second zip fastener 34 is shown at the forward end of its travel. Bar-tac arrangements (or alternative forms of reinforcement such as lock-stitching, or reinforcement tape, or a combination of these) are indicated by A,B,C,D,E, and G,F and can be used in addition to the top stitching 69,66 and 41 respectively to reinforce the stitching in that area. Different combinations of A,B,C,D,E can be employed, as can either or both of G,F. A can be horizontal or vertical. Box 45 refers to what is defined as the "apex" region.

Figure 3:
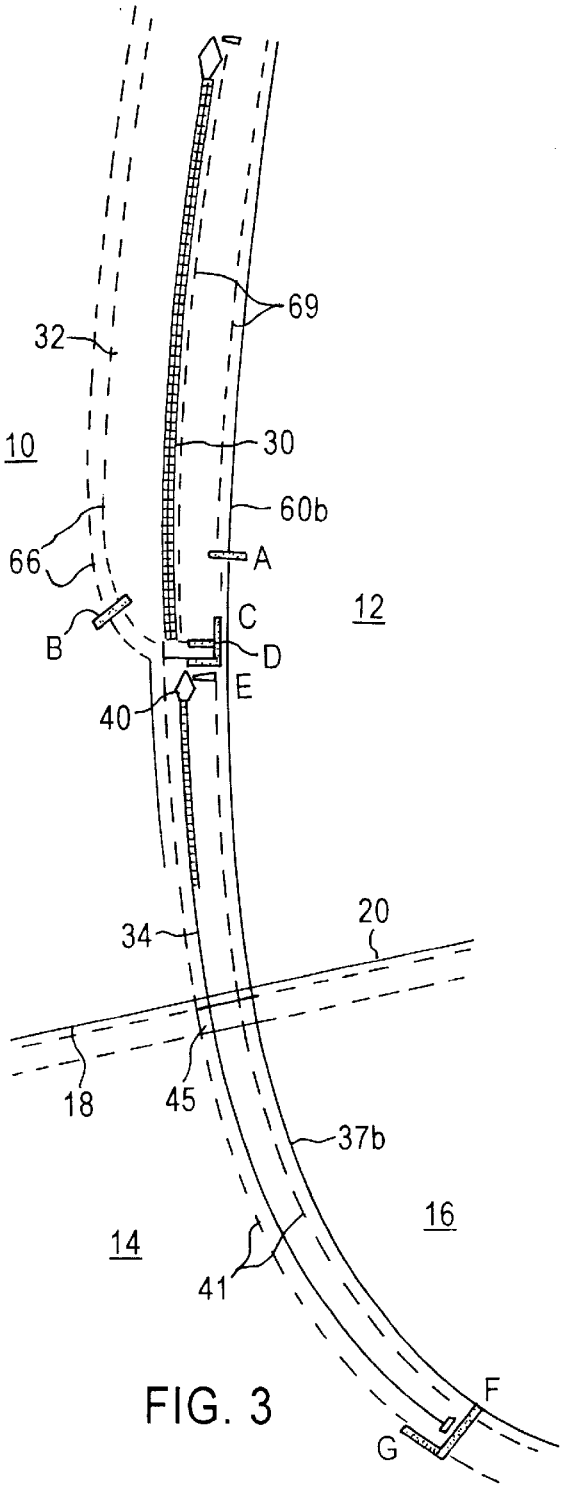
Figure 4:
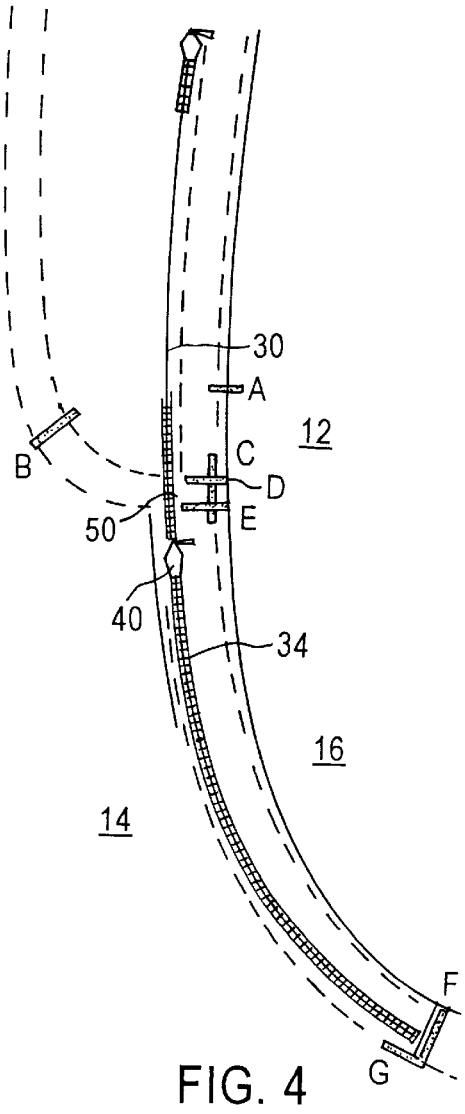
FIG. 4 is a see-through view of the front upper part of a further form of trousers showing the outer face and also the inner face.

FIG. 4 diagrammatically shows a see-through view of trousers generally similar to those of FIGS. 1, 3 and 4 except that continuous zip-teeth are sewn along the sides of the front fly 24 and the crotch fly 26 with a region of discontinuity in the form of stitching or a metal or plastic stop or other, 50, separating the first and second zip fasteners 30,34. Alternatively there may be no form of discontinuity 50 with the use of continuous zip-teeth, and this configuration may employ a single zip pulley or two zip pulleys, one following on from the other.

Alternatively two separate sets of zip-teeth 30 and 34 are provided whereby the upper end of the crotch zip runs directly beneath the path of the lower end of the front zip, or vice-versa, or that the respective ends of the two zips run alongside each other for a short distance.

Figure 5:
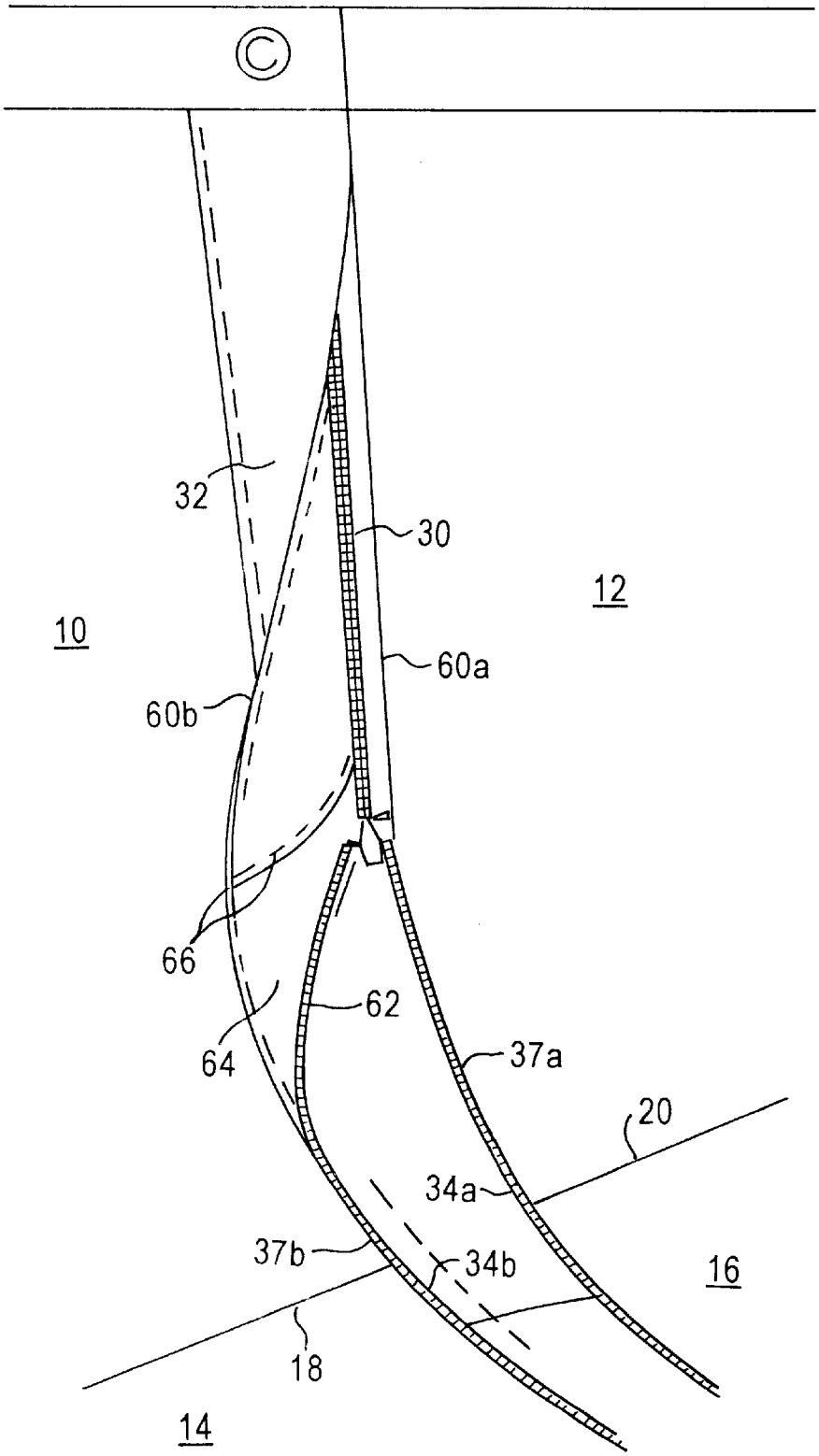
FIGS. 5 and 6 are views of the front upper part of lady's classic trousers with a concealed zip showing the outer and inner faces respectively, that of FIG. 5 showing the crotch zip open and the placket partly drawn back, and that of FIG. 6 showing both zips closed.
Figure 6:
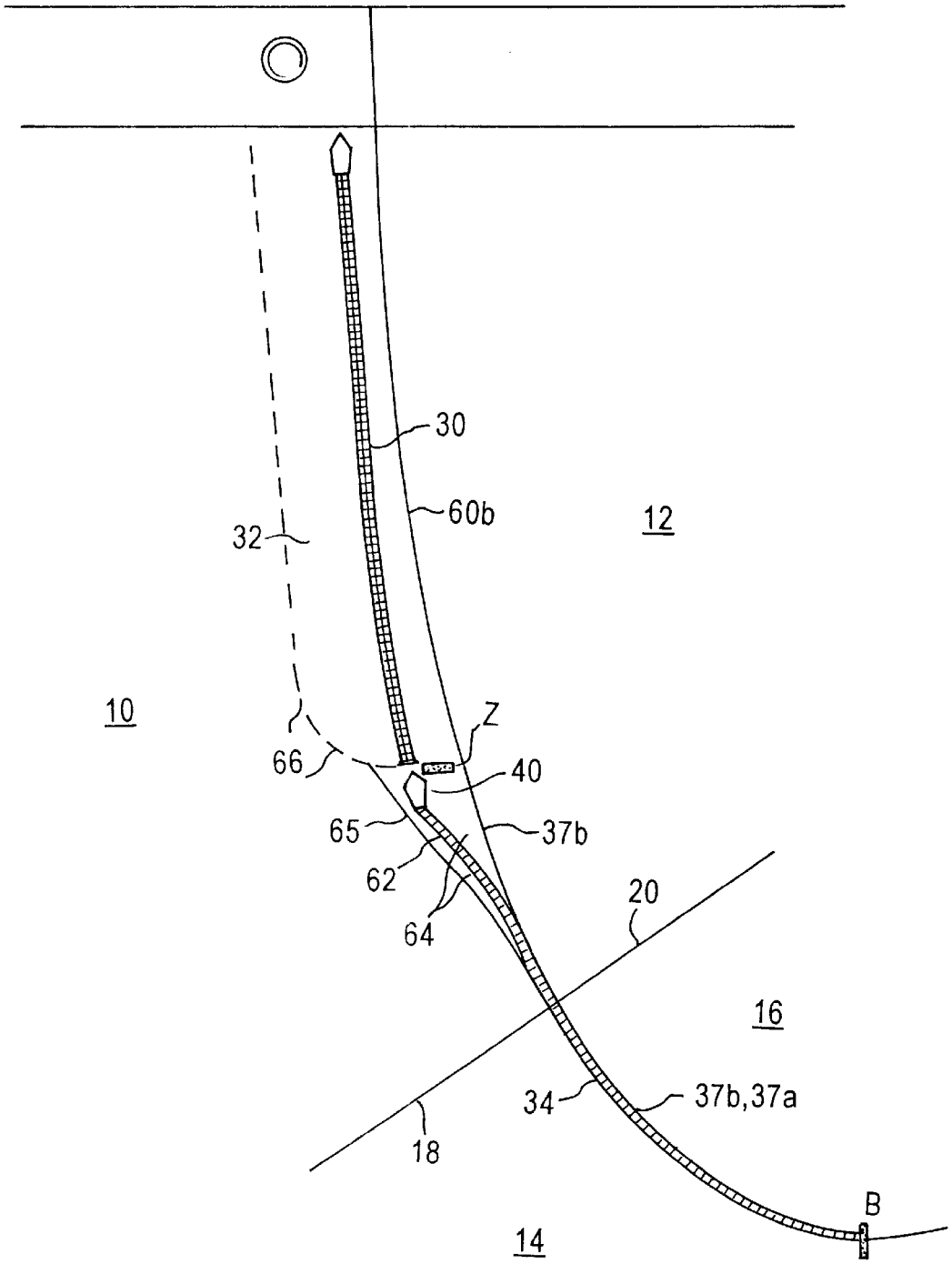

FIGS. 5 & 6 are views of a further form of the trousers in which there is used a concealed zip fastener i.e. a zip fastener whose tapes and teeth are on the concealed face of the fabric they are to join so that they are invisible from the exterior. A problem which arises in the use of a concealed zip is how to hide the zip pulley which has to be accessible but nevertheless needs to be concealed. From the outside of the garment there appears to be a line defined by a rolled seam that extends along the crotch fly opening 26 when in the closed position and the upper end of this line is then hidden behind the triangular flap 64. The front fly zip 30 is parallel to but slightly offset from the edge of panel 12, 60*a,* which is also a seam line. Crotch zip-teeth 34*b* deviate from their natural path adjacent to edge 37*b* at their upper end 62 which meets the lower end of the front fly zip 30. This deviation of the zip-teeth 34*b* is for an improved concealment of the zip pulley under a triangular flap 64 (in the closed position of the crotch zip) which is thereby created by the deviation. In FIG. 6 edges 37*a* and 37*b* coincide at their lower ends forming the roll seam. Where deviation of 34*b* occurs at 62, the edge 37*b* overlaps 37*a* providing room for concealment of the zip pulley. At the rear of the crotch zip where the rear seam begins there is provided a reinforcement tape (or 'stay' tape) that is attached to both side panels of the garment on the interior of the garment along the line where they meet adjacent to the rear seam; this tape cannot be seen from the exterior and is an alternative to bar-tac stitching reinforcing the strength of the stitching along the rear seam in that region.

Figure 7:
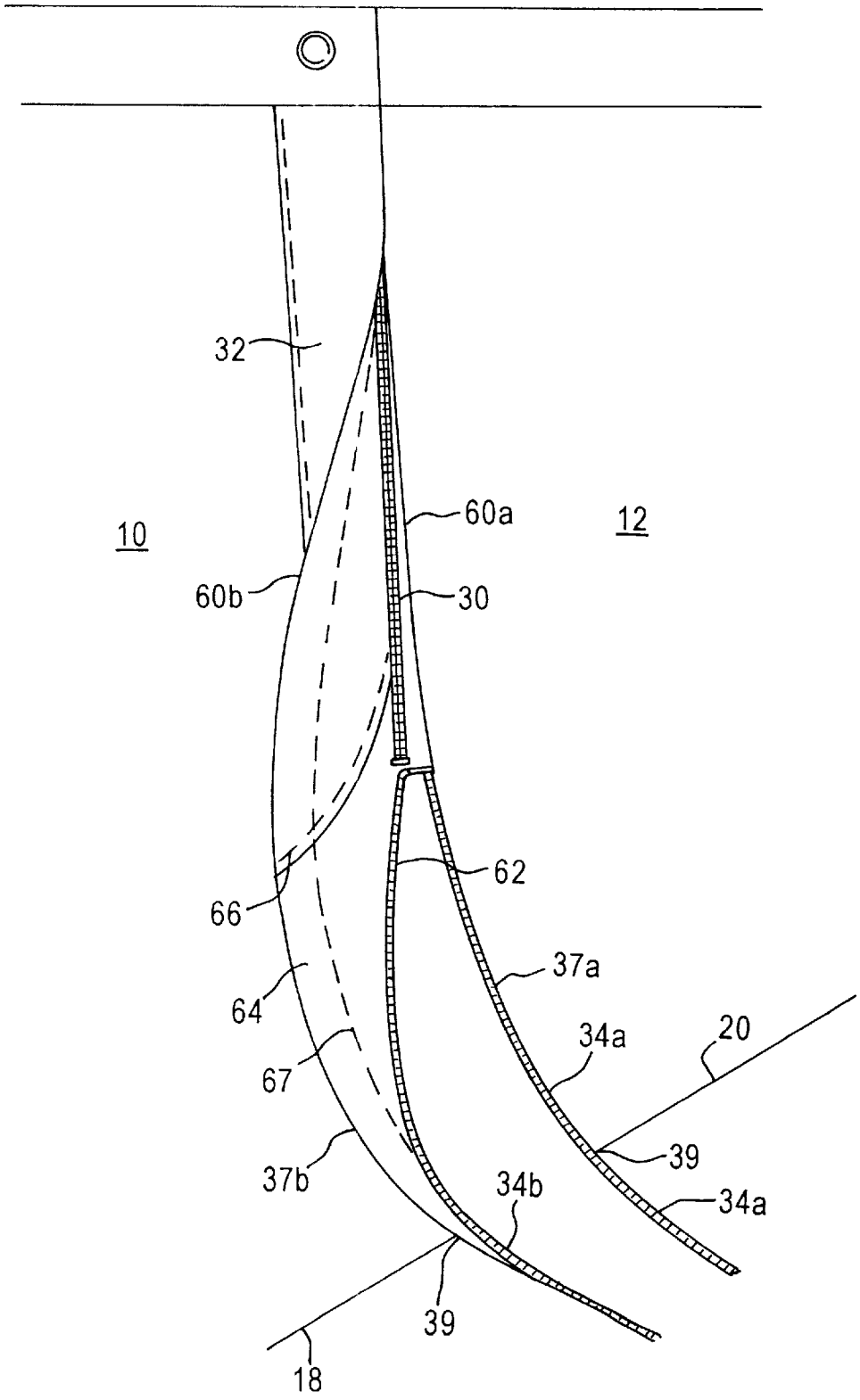
FIGS. 7–10 are views of the front upper part of a further form of lady's trousers.
Figure 8:
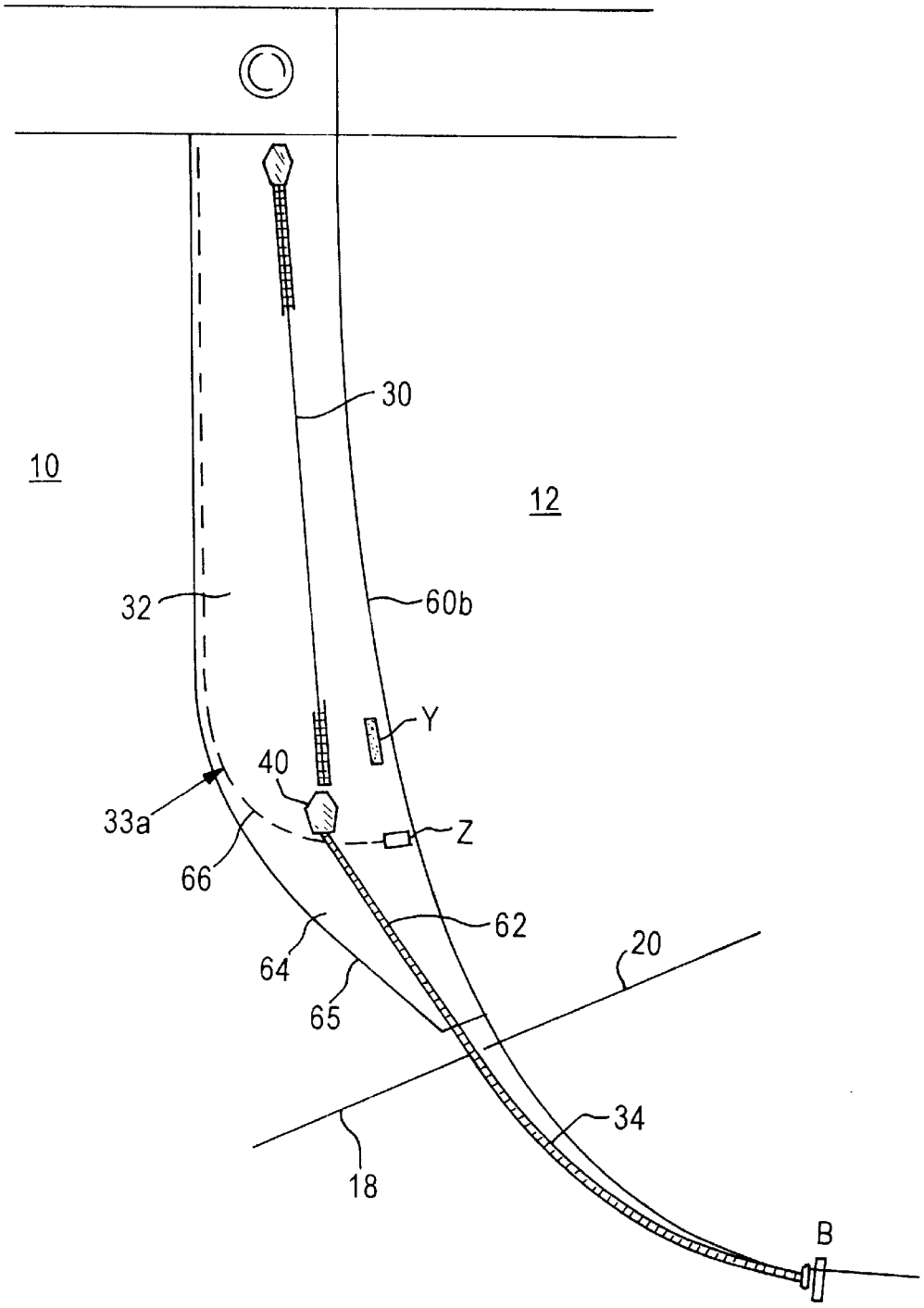

In FIGS. 7 & 8 there is shown part of a pair of lady's classics trousers like these in FIGS. 5 & 6 except now there is an accentuated "lip" in the cut of the garment in terms of the edge line 60*b*/37*b* embodying a greater curvature than previously, which may be achieved by the provision of extra material in that area, with which to conceal the crotch zip pulley 40 when the crotch zip 34 is in the closed position as in FIG. 8.

In FIGS. 5 & 6 the "lip" that is defined by the extent of the edge liners 60*b*/37*b* is cut as in standard women's trousers. In FIGS. 7 & 8 the triangular 64 that is formed is both wider and longer and is achieved by the accentuated curvature of the lip as well as by a deviation of the zip-teeth 34*b*. This accentuated curvature and provision of extra material implies that edge 37*b* typically meets the zip-teeth 34*b* at a region just below the point 39 in the apex area 45.

In FIGS. 7 & 8 the extra "lip" configuration has been illustrated in conjunction with a deviation of zip-teeth 34*b*. Alternatively this lip may be constructed without the provision of zip deviation and still allow for sufficient concealment of the zip pulley 40 while retaining easy accessibility to the zip pulley 40 for the wearer of the garment.

In FIGS. 7 & 8 is depicted a change in the structure of the placket 32 ("upper placket") of the front fly 24 as is standard in trousers and shorts. Concealment of zip pulley 40 in the region above the line of the lower horizontal end of top-stitching 66 implies that the attachment of panel 10 (or of the interior facing of placket 32 which is attached to panel 10 by top-stitching 66) to panel 12 at the point Z is removed. This attachment at Z constitutes top-switching 66 typically being sewn additionally onto panel 12 and may also constitute further forms of reinforcement such as lock-stitches, side-stitches or bar-tacs, and defines the extent of the upper placket 32. This removal of attachment at Z may also occur as in FIG. 6 where the zip pulley 40 rests at a point below the line of the lower horizontal end of top-stitching 66 in order to allow for space to access the pulley 40. Attachment at Z now being removed there is an attachment of panel 10 (or of the interior facing of placket 32 which is attached to panel 10 by top-stitching 66) to panel 12 at some point above Z and close to edge 60*b* to prevent rolling back of edge 60*b* when the garment is being worn. This attachment may for example occur at point Y and will constitute either top-stitching in that region, or some other means of reinforcement (e.g. bar-tacs, lock-stitches, side-stitches etc.) or a combination of these.

Figure 9:
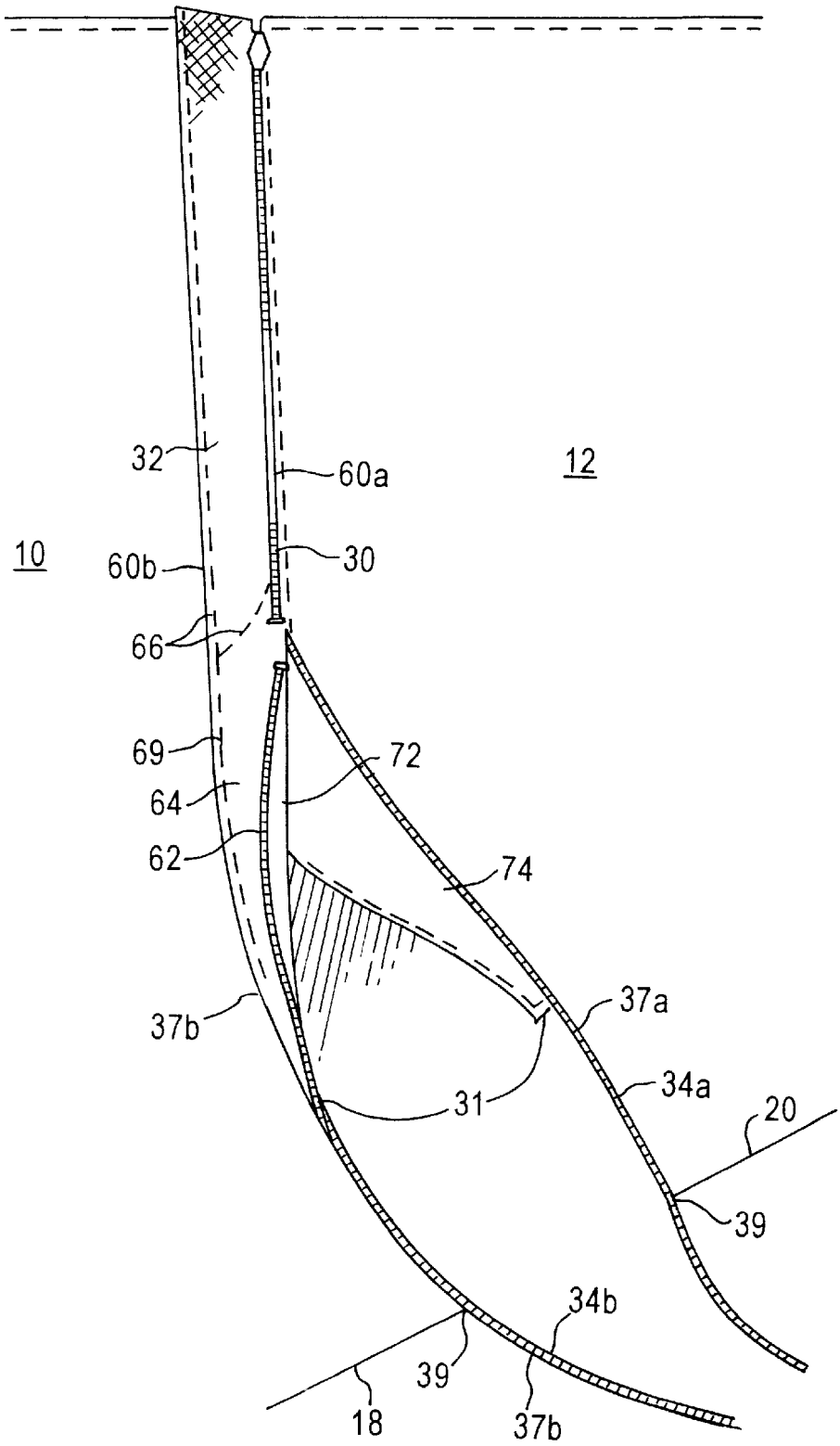
Figure 10:
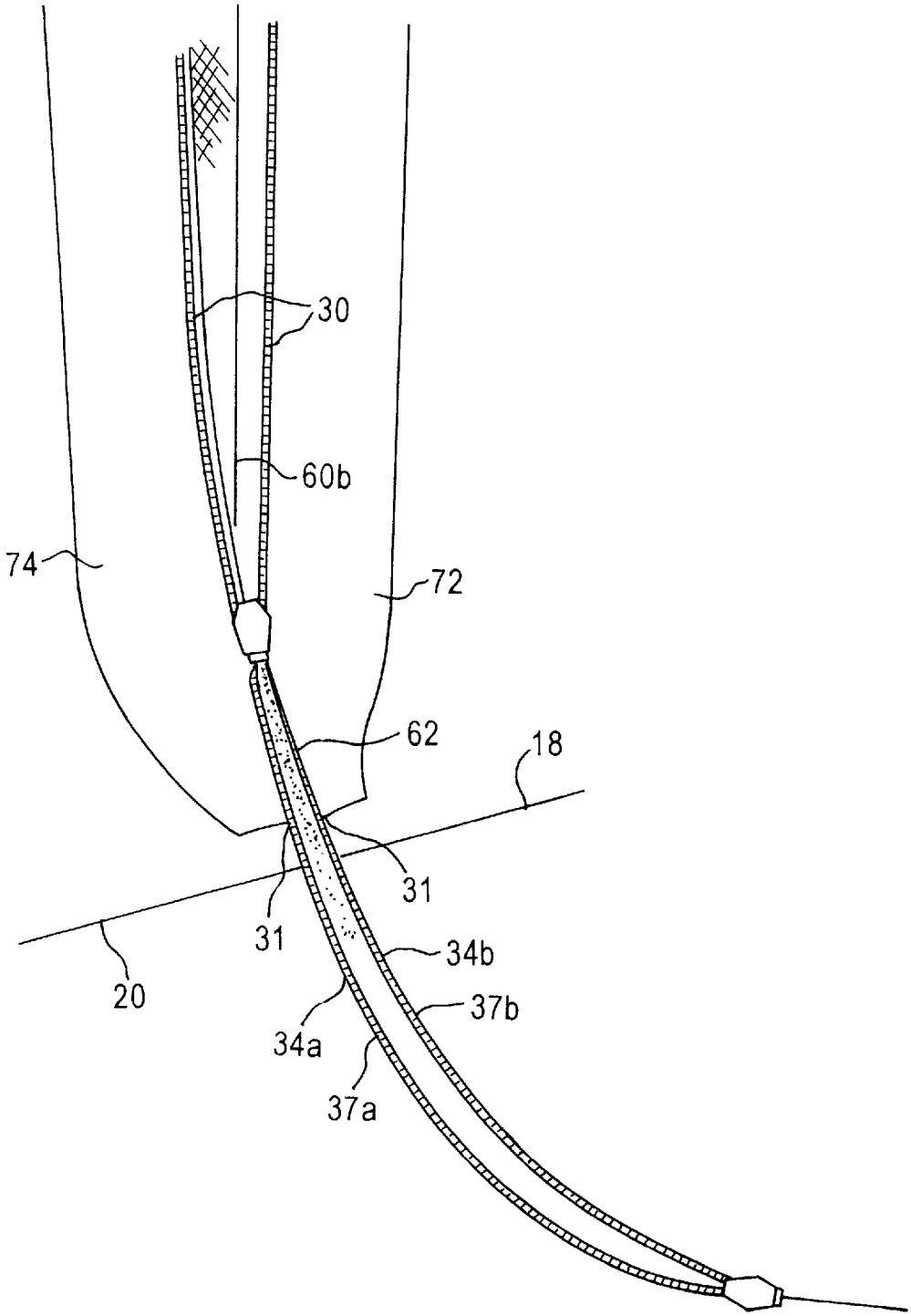

In FIG. 9 there is shown part of a pair of trousers as in FIG. 7,8 except now with the interior facings 72,74 being illustrated. Top-stitching 69 is also illustrated which is the stitching along edge 60*b*/37*b*. FIG. 10 is a reverse view of the same garment from the interior illustrating interior facings 72,74. The upper part of edge 60*b* can just be seen, when the front zip 30 is open, from this reverse view of the interior. Owing to the nature of the function(s) of the crotch zip a continuation of interior facings 72,74 past the region indicated by points 31 impedes the unobstructed access both to and from the perineal area of the female and is therefore undesirable for most of the length of the crotch zip. Preferably facings 72,74 should have an extension that is not beyond the region indicated by points 31. Alternatively the interior facings may become narrower in their width past the region of points 31 and extend along a further length of the crotch zip 34 such that they are sufficiently narrow so as to be unobtrusive to the uses of the crotch zip when open.

Figure 11:
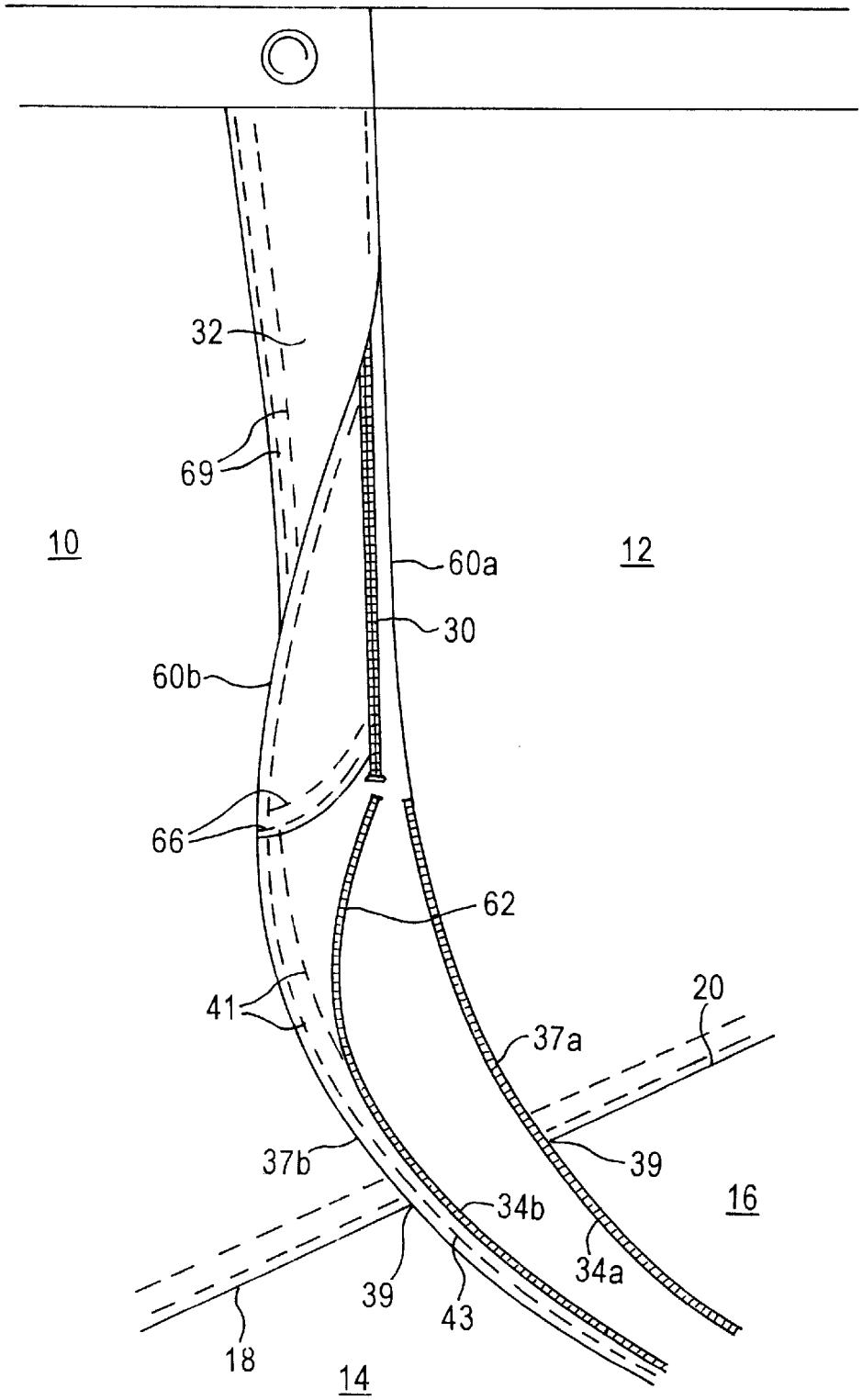
FIGS. 11–12 are views of the front upper part of jeans cut trousers incorporating a concealed zip.
Figure 12:
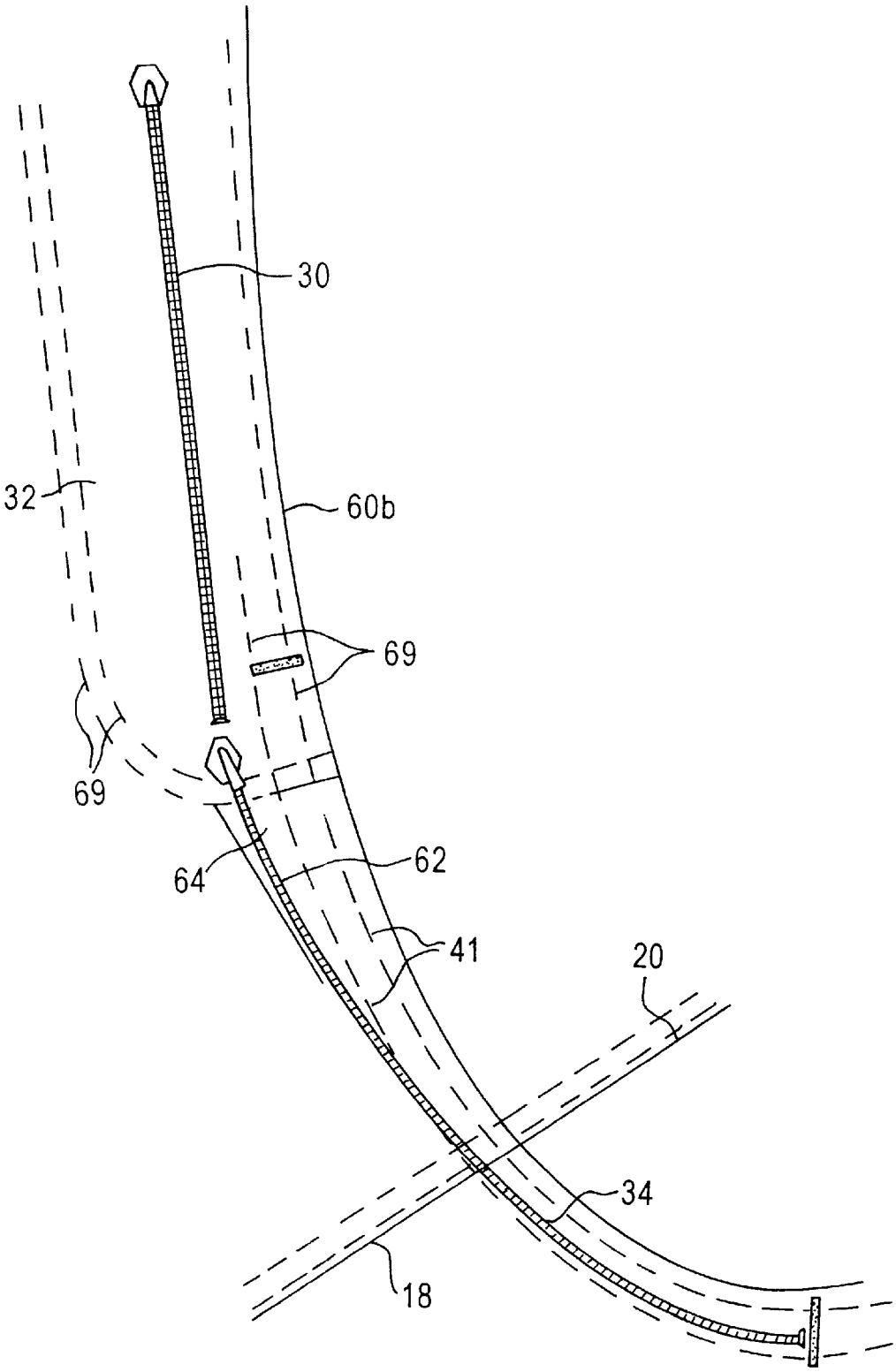

In FIGS. 11 & 12 there is shown the upper part of a pair of trousers of a jeans cut, comprising a standard front fly and a deviating crotch zip as in FIGS. 5,6 except now zip-teeth 34*b* are separated from the edge 37*b* even along its lower end by a narrow facing of material 43 or by a foldover 43 of material along the edge 37*b* of panels 10 and 14. This facing or foldover 43 gives a ridge seam effect of the jean when accompanied by top-stitching 41 on the exterior and provides a further concealment, as in a narrow version of flap 36, of the concealed zip as well as adding a greater extent of material for zip pulley concealment in the region of the "lip". When both the upper fly and the crotch fly are in a closed position the top-stitching 69 follows in a continuous path from top-stitching 41 to give the jeans cut effect on the exterior of the garment, as shown in FIG. 12. Typically the width of the facing or foldover 43 is not greater than 1 cm (⅜").

Alternatively in the above there is provided an extra lip as depicted in FIGS. 7 & 8 for improved zip pulley concealment, with analogous changes as before yet maintaining facing or foldover 43 of a similar width as before. Further the extra lip may be constructed without the provision of the deviating zip-teeth 34*b* with analogous changes maintaining the facing or foldover 43.

Figure 13:
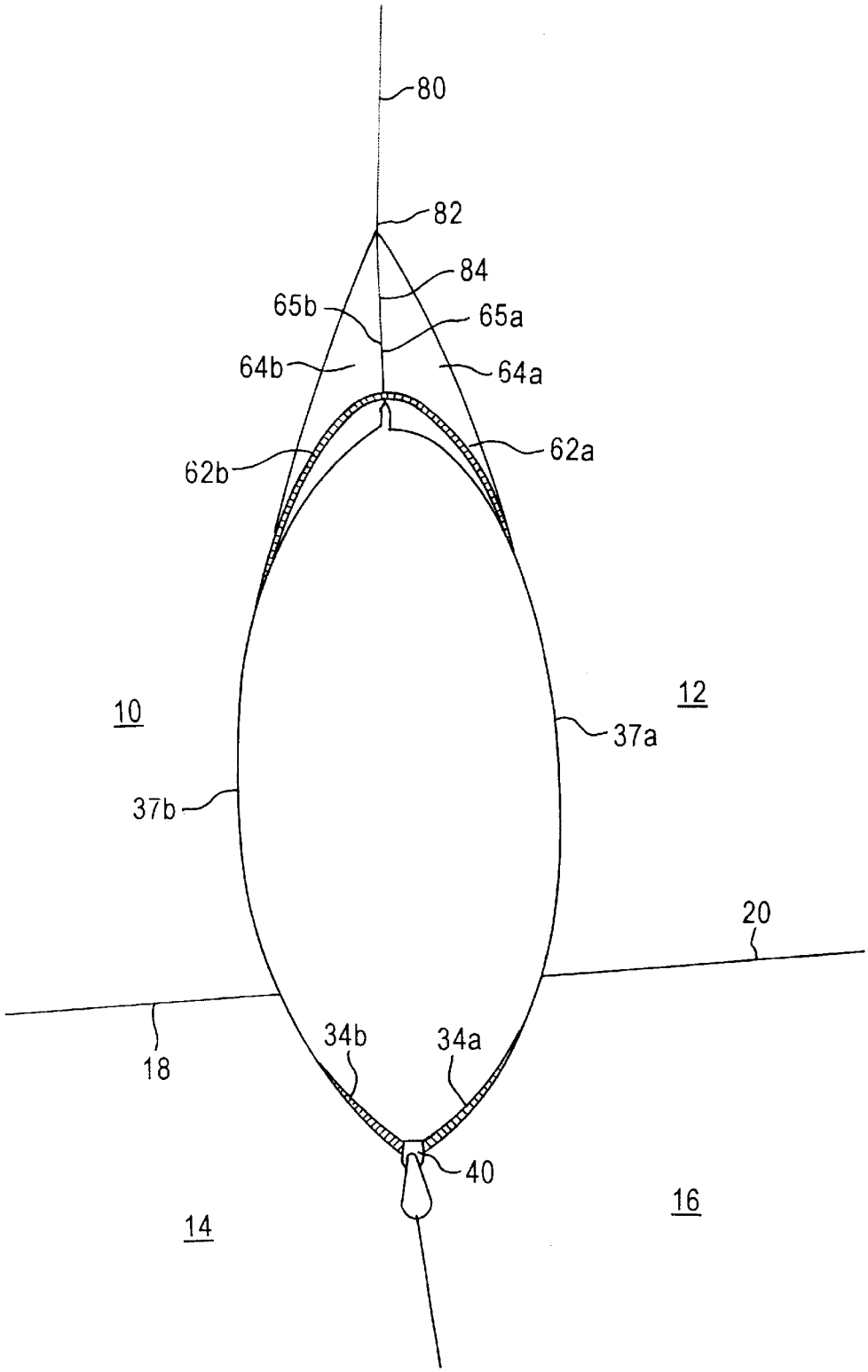
FIG. 13 is a view of the front upper part of a further form of lady's classics trousers in which there is a crotch fly with no front fly.

In FIG. 13 there is shown a pair of lady's classics trousers with a crotch fly along the perineal region and in which there is no longer a front fly but typically some alternative means of opening the upper part of the garment for removal and putting on, e.g. and elasticated waistband or a fly depending from the waistband at one of the sides of the garment.

In FIG. 13 there is shown a concealed-zip fastener whose zip teeth deviate on each side at their front ends, (along the edge of extended panel fabric provided on each side towards the front deviating ends), from their natural paths along edges 37*a,* 37*b,* in the direction of the edges of respective extended panel fabric provided in panels 10, 12, thereby creating triangular flaps 64*a* and 64*b* with which to conceal the pulley of the zip when closed. The extended panel fabric on each side folds over along the edges 65*a* and 65*b* such that when the zip is closed: (i) edges 37*a* and 37*b* meet along the non-deviating extent of the crotch fly and form an apparent seam line that is closed; and (ii) foldover edges 65*a* and 65*b* meet to give an apparent seam line 84 that is an open seam but appears to be a closed seam when the trouser is worn and that continues in line from the (closed) front seam 80 and is followed by the (closed) apparent seam line 37*a*/37*b*.

Alternatively, additional or replacement faced-in material may be attached on or along either or both of the sides or edges 65*a* and 65*b* that folds to the underside(s) of triangular concealment flaps 64*a* and 64*b* respectively; each of the deviating ends 62*a* and 62*b* of the zip would then be attached to the underside of each of the faced-in material pieces.

Alternatively edges 65*a* and 65*b* may be formed so as to overlap when the zip is closed.

Alternatively the open seam 84 that is formed when the zip is closed and edges 65*a* and 65*b* meet (or overlap) may be partially sealed (i.e. closed) by stitching together of the folded edges 65*a* and 65*b* and this may enhance the way in which the open seam appears as a closed seam when the zip is closed and the garment is worn. Typically the open seam 84 is partially scaled along its top end at point 82; this may be achieved by lengthening the extent of the (closed) front seam 80 and thereby lowering the end of the front seam at 82.

The extended panel fabric of the garment beyond the stitching line of the central front seam folds to the interior of the garment; it is onto each of these extended panels on the interior that each of the deviating ends of the zip are attached respectively. Alternatively there may be separate material pieces that are faced-in to each of the extended panels of the trouser as they fold over beyond the stitching line of the central front seam to the interior of the garment.

These extended panels are typically narrower on the interior where there is a lesser degree of deviation of each side of the zip. There is also a short line of stitching provided that attaches together the two extended panels on the interior side of the garment along a region close to the top end of the zip on the interior and (typically) to the interior edges of the extended panels so as to ensure that the head of the pulley of the zip is easily retrievable by the wearer, such stitching providing a stop to the extent that the head of the pulley rolls back when the zip is closed.

It may be noted that where the zip deviates on both sides a lesser angle of deviation of each of the sides of the zip is required to effectively conceal the pulley of the zip (when it is closed) than the angular deviation that is required when only one side of the zip deviates. Further, where the stitching of front seam 80 extends further along, providing a partial closure of the otherwise fully 'open' apparent seam line that is created when the zip is closed, there is also required a lesser angle (and depth) of the deviation of the zip to ensure that the pulley is effectively concealed when the zip is closed and the trouser is worn; the partial closure in this sense of the otherwise 'open' seam along the deviating extent of the zip also generates a more effective illusion or concealment of the 'open' seam as an apparent closed seam when the zip is closed and the trouser is worn.

A rough guide to the range of angles of deviation of the sides of the zip away from their path along or parallel to the line of the crotch is as follows [this is relevant to designs where there is a crotch fly with no front fly or where the front fly is set at a distance from the crotch fly]: where only one side deviates and there is a fully open seam along the extent of the deviating end, deviating one side of the zip from between 30° (min.) and 90° (max.) can achieve a full concealment of the pulley when the zip is closed; where there is a partially closed seam over the upper end of the pulley when the zip is closed, deviation of between 15° and 90° will suffice. Where both sides deviate and there is a fully open seam, there may be deviation of between 15° and 45° on each side; where both sides deviate and there is a partially closed seam, deviation of between 7° and 45° will suffice. It must be noted that this guide is an approximate: the precise angles depend also on the nature and weight of the fabric, the width of the zip and the size of the pulley of the zip and the head of the pulley, and whether the head of the pulley 'locks in' to the pulley and zip when it is pressed.

Figure 14:
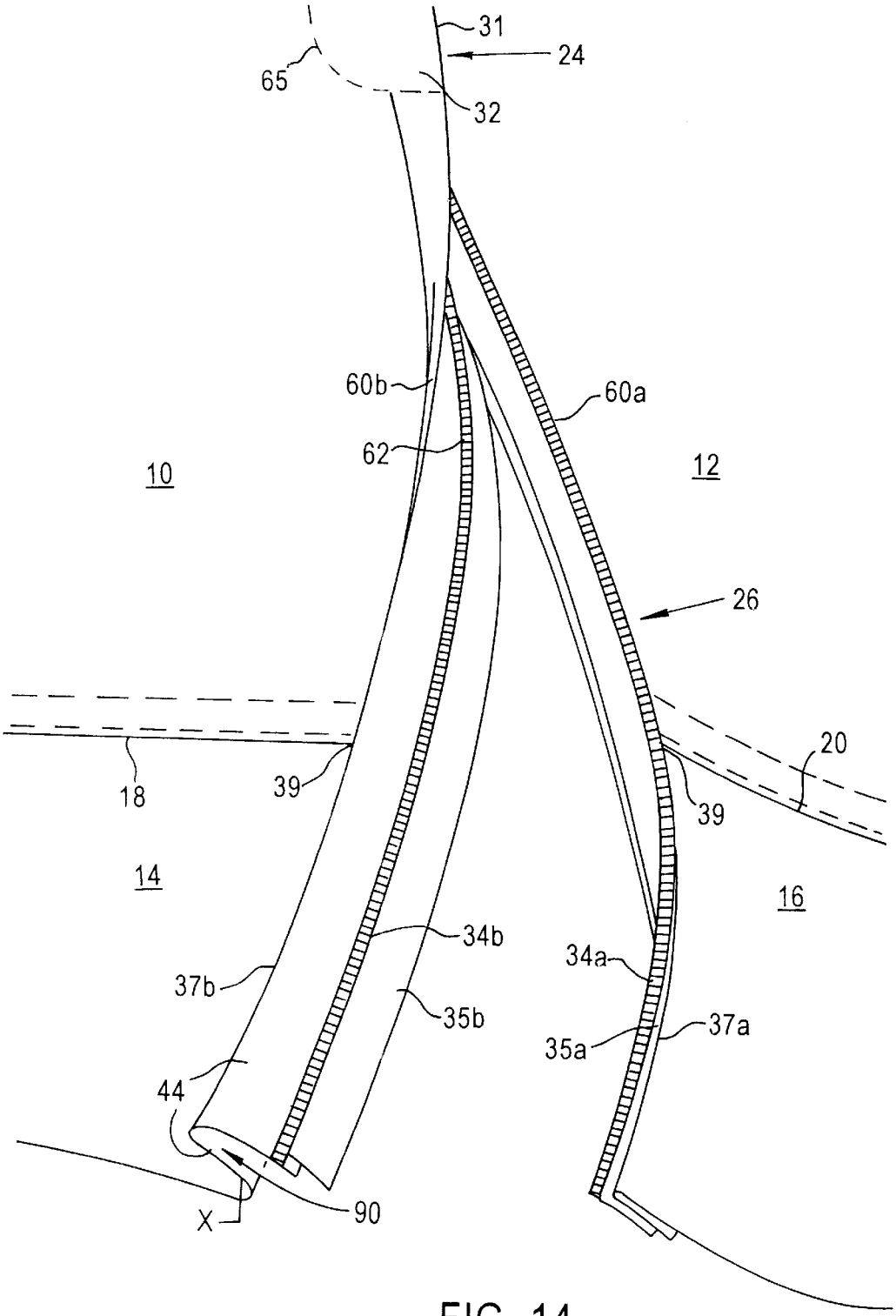
FIGS. 14–16 are views of the front upper part of further forms of lady's classics trousers with a front fly and a crotch fly.

FIG. 14 shows a pair of ladies' classics trousers provided with a front fly 24 and a crotch fly 26. A regular zip 34 is depicted, of which one side of the zip teeth 34*b* and the corresponding zip tape 35*b* are attached to the underside of a 'concealment' flap 44 which covers the zip 34 when the crotch fly is closed and the flap 44 lies flat onto the sides 12 and 16 of the garment.

Flap 44 is formed by extending panels 10 and 14 along the length of such flap and by folding over the extended panel fabric to create folded edge 37*b*/60*b* that rests against panels 12 and 16 to cover the crotch zip 34 and the edge 37*a*/60*a* when the zip 34 is closed. When zip 34 is closed and flap 44 lies flat onto the sides of the trouser, the line of meeting of edge 37*b*/60*b* with the sides of the trouser gives the appearance of a closed seam along the crotch.

In the absence of top-stitching applied to the inside edge of flap 44 along a line indicated as commencing from point X, such top-stitching providing an inner boundary to the flap and thereby assisting the flap's tendency to lie flat onto the sides of the garment when it is worn, it may be necessary to apply a heat adhesive interfacing (such as, for example, the heat adhesive interfacing commonly known as 'wonderweb') along the inside 90 of folded edge 37*b*/60*b* so as to (i) make it sharper and more crisp; and (ii) to enhance the 'staying flat' properties of the folded edge when the zip is closed (this is a novel use of such heat adhesive interfacing) owing to the added strength of the interfacing-enhanced fold. The absence of visible top-stitching along the exterior side (not shown in FIG. 15) of flap 44 is preferable (than a visibly top-stitched flap) in this classic-type design of trouser as then the presence of flap 44 is better concealed when the zip 34 is closed and the trouser is worn.

The front fly placket 32 is conventionally constructed of panel fabric having top-stitching 65 that is faced in on its underside by a separate piece of fabric that may or may not be the same material as the panel fabric. Flap 44, being extended panel fabric that is folded over, is separate from placket 32 of the front fly, although edge 60*b*/37*b* appears to follow in a continuous line from edge 31 of the front fly placket giving the outward appearance of edge 60*b*/37*b* as a conventional closed seam line in the crotch when the zip 34 is closed and the trouser is worn. Alternatively, there may be not front fly and no placket 32.

Alternatively, flap 44 may be constructed as a continuation of placket 32, both plackets having separate facings or both being extended and folded over.

Alternatively again, there may be provided a garment as above but with a flap (as in flap 44) along each side of the zip of the crotch fly, both flaps meeting or overlapping to cover the zip 34 when the fly is closed. In the case of there being two flaps, each flap may be of a lesser width than where there is only one flap.

Alternatively, flap 44 may be constructed as a continuation of placket 32, the front fly placket being faced in with a separate material piece while the crotch fly placket 44 is simply extended and folded over (or vice-versa). (One advantage of a placket in the crotch region constructed with a separate faced in material piece is that the faced in piece helps the placket along the crotch align to the curved contour of the crotch line. Also, a faced in material piece gives the placket a sharper outside edge in the absence of any heat adhesive interfacing applied).

Figure 15:
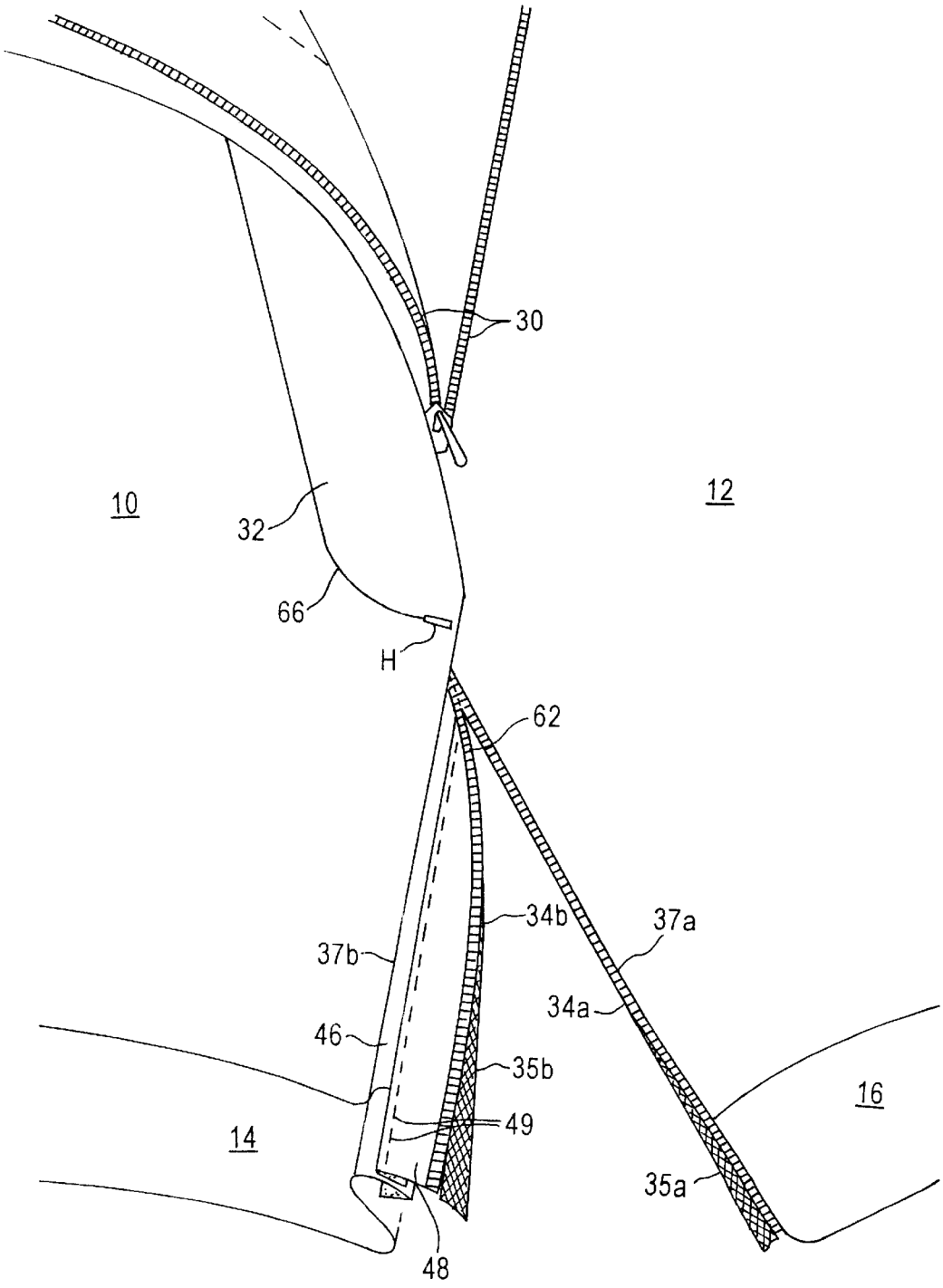
Figure 16:
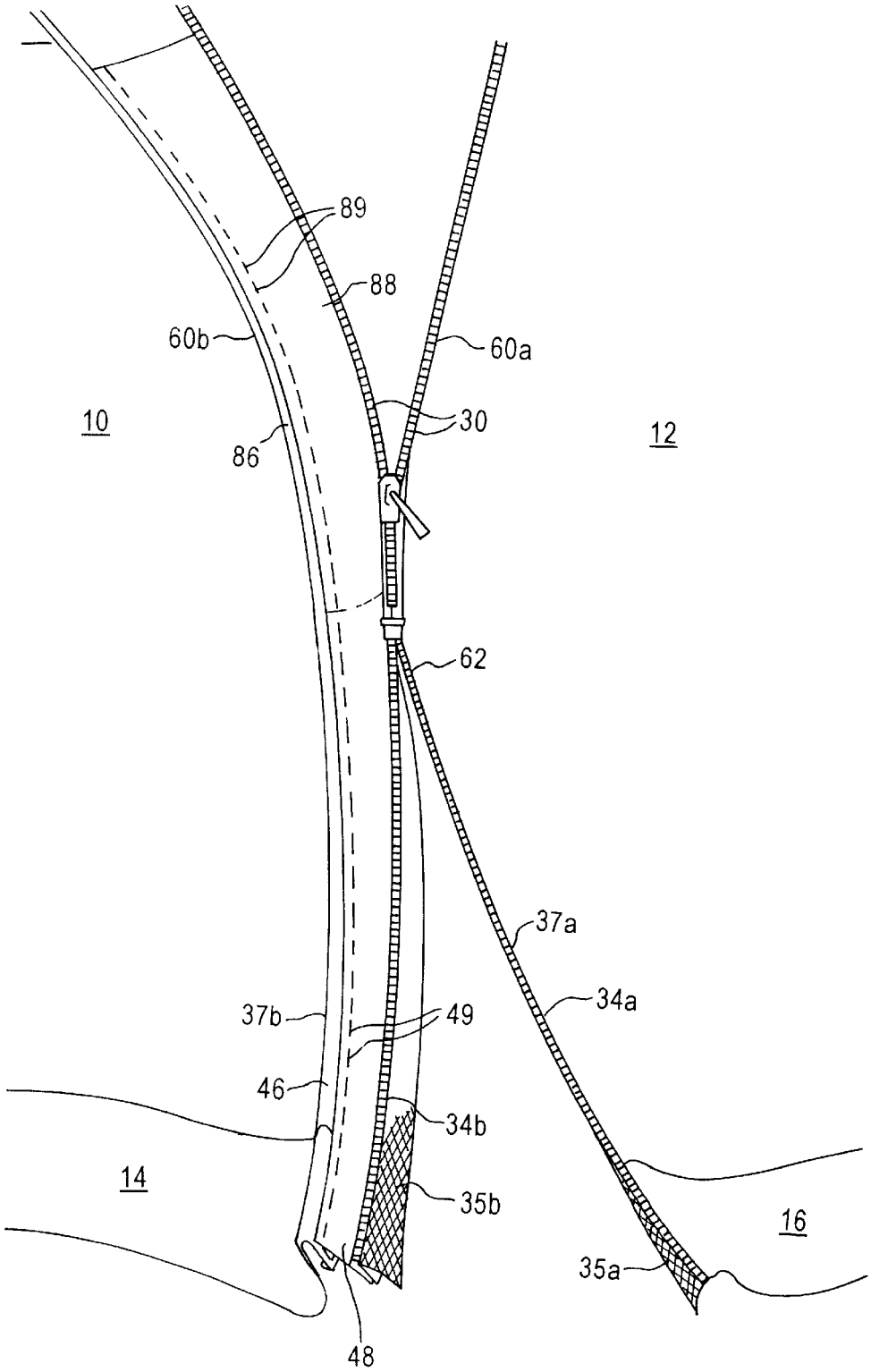

FIGS. 15 and 16 show the same pair of ladies' classics trousers with a front fly and a crotch fly, and a front fly packet 32 that is faced in with fabric 88 and that extends over the full length of the crotch fly.

FIGS. 15 and 16 are both front views of trouser with both flies open, with bar-tack stitching at H removed and with the placket fully rolled back in FIG. 16. The faced in fabric 48/88 is attached along stitch-line 49/89 to the underside 46/86 of the extended panel fabric that is folded over along edge 37*b*/60*b*. With bar-tac stitching at H in place, when the crotch fly is closed edge 37*b* overlaps edge 37*a* and gives the appearance or illusion of a conventional closed crotch seam line when the trouser is worn.

FIGS. 17*a* and 17*b* show a pair of ladies' classics trousers with no front fly and a crotch fly with a concealed zip of which both sides are attached to the edges of the panels along the full length of the zip. When the crotch fly is closed as in FIG. 17*b* the button 92 is connected with button hole flap 94 to cover the otherwise exposed pulley 40 of the crotch zip, the crotch zip 34 giving the appearance of a conventional closed seam. No zip deviation may be necessary in this instance.

In the described embodiments, the zip of the crotch fly opens from front to rear. Alternatively, the zip can be provided the other way round to open towards the front.

Likewise, in the embodiments having a deviating zip, the deviating end of the zip may lie towards the rear end of the zip with the pulley of the zip moving in the reverse direction and resting at the rear end when the zip is closed.

Garments embodying the present invention will preferably have a crotch fly that is limited in its extension to the perineal area as opposed to extending as far as the rear waist.

Bar-tacs G,F as in FIG. 3 are necessary for reinforcing the stitching at the disjunction at the rear end of the crotch zip 34 and the rear seam 28. This bar-tac (either G or F could be used or a combination of both) can be replaced by alternative forms of reinforcement e.g. lock stitching, side-stitching, reinforcement ('stay') tape or other. Each of these reinforcement means can be used in conjunction with another and especially so in the case of bar-tacs or lock-stitches used in conjunction with reinforcement tape. This reinforcement is required to prevent the stitching becoming undone as well as to prevent avoidable wear and tear at this critical region of the garment with continual use. Without this bar-tac configuration the garment is rendered impractical for regular use especially in view of the increased tension that is generated in this region when the legs of the female are spread as for urination or other. Otherwise with time the garment would fall apart, as it were.

With garments that require a change in the structure of the upper placket 32 to enable concealment of zip pulley 40 certain bar-tac arrangements (or other reinforcing means) are necessary to ensure that when the garment is worn the edge 60*b* does not easily roll back exposing the interior workings in that area. Such arrangements require top-stitching or a bar-tac or other reinforcement that attaches the panel 10 (or the interior facing of placket 32) to the panel 12 at a point in the region above point Z as in FIG. 8 and close to the edge 60*b* so as to retain easy access to the zip pulley 40 and yet so as not to obstruct access to a minimum workable region of the front fly. A combination of the reinforcement/attachment means can also be used. If top-stitching is used in this region as a means for preventing the rolling back of edge 60*b* then bar-tacs etc. may be used either as a further means of attachment of the panels or as a means of reinforcing the strength of the top-stitching itself. These arrangements do not necessarily require either the deviating zip or extra lip configurations. It is feasible that the upper zip 30 or button configuration 38 or other extends down a shorter distance than the extent indicated in FIG. 8 e.g. as far as the region Y; typically this extent will be a minimum of 15 cm (6").

The flap 36 as in FIG. 1 which has the appearance of a ridge seam is designed to conceal either or both of the crotch zip 34 and the zip pulley 40. Preferably this flap must be broad enough in width to cover the extent of the zip 34 and width of pulley 40 when the pulley is lying vertically in line with the zip 34 when it is in the closed position, and yet narrow enough so as to prevent avoidable rolling of the flap itself when the garment is being worn. Preferably this flap will be of a width between 3 mm (⅛") and 10 mm (⅜"). A flap that is too narrow may also face the problem of lying flat upon the panel material of the garment when worn. Flaps that are wider than 10 mm may incur the risk of zip jamming resulting from the zip pulley 40 catching onto edges of the flap, and may also impede the clean efflux of bodily fluids from the perineal area.

Flap 36 is typically of a similar width to the raised rear seam of the jean. This is especially important when the crotch fly (and hence the flap) extends further than 4 ½ inches to the rear of the 'apex' of the jean in which case a wider flap would show up at the lower end of the rear of the jean when it is worn, thereby revealing the presence of a wider 'ridge' along the rear of the crotch to a keen observer and thereby (undesirable) suggesting the presence of a covered opening in the crotch (or at least a badly designed jean.)

There may be advantages in the use of a single set of zip-teeth with some means separating the front zip and the crotch zip as depicted in FIG. 5: these include a stronger structure of the garment at the critical region of disjunction of the two zips owing to the continuation nature of the zip-teeth; the single set of zip-teeth is generally easier to mount onto the fabric of the garment than two separate sets of zip-teeth; the single set of zip-teeth is generally aesthetically more pleasing upon inspection of the interior workings of the garment in that region.

What is claimed is:

1. An article of clothing having a crotch portion separating two leg portions, and having in the crotch portion a crotch fly extending along the perineal region of a seam line joining the two leg portions, the crotch fly being openable and closable by a fastening arrangement which in the closed position is concealed, wherein the fastening arrangement is provided along a line in the crotch portion in such a manner as to give the appearance of an extension of said seam line in the closed position.

2. An article of clothing having a crotch portion separating two leg portions, and having in the crotch portion and as far as the rear waist a crotch fly openable and closable by a fastening arrangement which in the closed position is concealed, wherein the fastening arrangement is provided along a line in the crotch portion in such a manner as to give the appearance of a seam line joining the two leg portions in the closed position.

3. An article of clothing as in claim 1 in which the fastening arrangement comprise an invisible zipper.

4. An article of clothing as in claim 1 in which the fastening arrangement comprise a zipper concealed behind a flap of material provided with at least a stitching line forming an extension of and/or simulating at least a seam stitching line at the front and/or rear of the article of clothing.

5. An article of clothing as in claim 3 in which the zipper extends along said seam line but is arranged at one end at least to deviate away from said seam line, and in which at least a widened flap portion is provided for covering said at least one end and for concealing an enlarged end portion of the zipper.

6. An article of clothing as in claim 5 in which the at least widened flap portion creates an open seam having at least one folded edge which follows said seam line when the zipper is closed.

7. An article of clothing as in claim 3 in which the zipper extends along said seam line but in which a widened flap portion having an edge deviating beyond said seam line is provided on at least one side and at at least one end of the zipper for concealing an enlarged end portion of the zipper.

8. An article of clothing as in claim 5 in which said at least one end of the zipper is arranged to deviate on only one side of the zipper.

9. An article of clothing as in claim 1 having a front fly as well as a crotch fly, both the front fly and the crotch fly being closed by zip fastening means, and in which a lower end of the zip fastening means of the front fly is arranged adjacent to a front end of the zip fastening means of the crotch fly.

10. An article of clothing as in claim 9 in which a region of discontinuity, comprising bar stitching or a supplementary stop element, is arranged to separate the front fly from the crotch fly and is provided just above the front end of the crotch fly.

11. An article of clothing having a front fly, a crotch portion separating two leg portions, and in the crotch portion, a crotch fly extending along the perineal region of a seam line joining the two leg portions, both the front fly and crotch fly being openable and closable by a zip fastener, wherein the zip fastener of the crotch fly are concealed in the closed position and are provided along a line in the crotch portion in such a manner as to give the appearance of an extension of said seam line in the closed position, and wherein the lower end of the zip fastener of the front fly overlaps, or is overlapped by, and is arranged adjacent to the front end of the zip fastener of the crotch fly.

12. An article of clothing as in claim 9 in which the front fly and the crotch fly have a single continuous zipper for both flies.

13. An article of clothing as in any of claims 9 in which the front fly has a front fly packet arranged to form a closure for at least the front end of the crotch fly.

14. An article of clothing as in claim 3 in which the zipper extends parallel to said seam line but is arranged at one end at least to deviate away from said seam line, and in which at least a widened flap portion is provided for covering said at least one end and for concealing an enlarged end portion of the zipper.

15. An article of clothing as in claim 3 in which the zipper extends parallel to said seam line but in which a widened flap portion having an edge deviating beyond said seam line is provided on at least one side and at at least one end of the zipper for concealing an enlarged end portion of the zipper.

16. An article of clothing as in claim 14 in which said at least one end of the zipper is arranged to deviate on only one side of the zipper.

17. An article of clothing as in claim 11 in which the crotch fly extends as far as a rear waist of the article of clothing.

18. An article of clothing having a crotch portion separating two leg portions, and in the crotch portion, a crotch fly extending along the perineal region of a seam line joining the two leg portions, the crotch fly being openable and closable by a fastening arrangement which in the closed position is concealed, wherein the fastening arrangement is provided along a line in the crotch portion in such a manner as to give the appearance of an extension of said seam line in the closed position, and wherein a front portion between a front end of the crotch fly and a front waist of the article of clothing is formed without a front fly.

19. An article of clothing as in claim 18 in which at least a flap portion is provided at one end of the zipper for concealing an enlarged end portion of the zipper, said at least flap portion creates an open seam having at least one folded edge which follows said seam line when the zipper is closed.

* * * * *